US008678373B2

(12) United States Patent
Ito

(10) Patent No.: US 8,678,373 B2
(45) Date of Patent: Mar. 25, 2014

(54) CUT-SHEET FEEDER

(75) Inventor: Yuhiko Ito, Kiyosu (JP)

(73) Assignee: Ezawa Jimuki Co., Ltd., Kiyosu-Shi (JP)

( * ) Notice: Subject to any disclaimer, the term of this patent is extended or adjusted under 35 U.S.C. 154(b) by 0 days.

(21) Appl. No.: 13/995,725

(22) PCT Filed: Jan. 30, 2012

(86) PCT No.: PCT/JP2012/052035
§ 371 (c)(1),
(2), (4) Date: Jun. 19, 2013

(87) PCT Pub. No.: WO2012/105519
PCT Pub. Date: Aug. 9, 2012

(65) Prior Publication Data

US 2013/0292895 A1 Nov. 7, 2013

(30) Foreign Application Priority Data

Jan. 31, 2011 (JP) ..... 2011-018161

(51) Int. Cl.
*B65H 3/04* (2006.01)

(52) U.S. Cl.
USPC ..... 271/35; 271/34; 271/121

(58) Field of Classification Search
USPC ..... 271/35, 34
See application file for complete search history.

(56) References Cited

U.S. PATENT DOCUMENTS 3,933,350 A * 1/1976 Mignano ..... 271/10.09
4,557,472 A * 12/1985 Hannon ..... 271/133
4,715,593 A * 12/1987 Godlewski ..... 271/10.11
4,991,831 A 2/1991 Green
5,143,365 A 9/1992 Green
5,244,198 A * 9/1993 Green ..... 271/125
5,601,282 A * 2/1997 Milo et al. ..... 271/35
5,642,877 A * 7/1997 Green ..... 271/35

(Continued)

FOREIGN PATENT DOCUMENTS

JP A-04-507229 12/1992
JP A-06-504022 5/1994

(Continued)

OTHER PUBLICATIONS

Feb. 21, 2012 Written Opinion of the International Searching Authority issued in International Application No. PCT/JP2012/052035 (with translation).

(Continued)

*Primary Examiner* — Kaitlin Joerger
(74) *Attorney, Agent, or Firm* — Oliff PLC

(57) ABSTRACT

A cut-sheet feeder has a feed belt, a belt contact amount adjuster, and an inclined guide member. The belt makes contact with the lowermost cut sheet of a stack of cut sheets and feeds forward the cut sheet. The belt contact amount adjuster supports the stack of cut sheets while lifting the read portion thereof from the feed belt. The inclined guide member protrudes further upward than the belt contact amount adjuster and has a guide surface inclined forwardly downward. The guide surface lifts up the rear end portion of the stack of cut sheets and shifts forward the lowermost cut sheet. The position of the adjuster in the front-rear direction and the position of the guide member in the front-rear direction can be adjusted individually.

17 Claims, 30 Drawing Sheets

(56) References Cited

U.S. PATENT DOCUMENTS

| | | | | |
|---|---|---|---|---|
| 5,772,199 | A * | 6/1998 | Green | 271/10.06 |
| 8,342,510 | B2 * | 1/2013 | Ito | 271/124 |
| 2006/0220299 | A1 * | 10/2006 | Kaiping | 271/35 |
| 2009/0134564 | A1 * | 5/2009 | Kaiping | 271/35 |

FOREIGN PATENT DOCUMENTS

| | | |
|---|---|---|
| JP | A-08-217283 | 8/1996 |
| JP | A-10-250257 | 9/1998 |
| JP | A-2003-081472 | 3/2003 |
| JP | A-2010-168201 | 8/2010 |
| JP | B1-4886075 | 2/2012 |

OTHER PUBLICATIONS

Feb. 21, 2012 International Search Report issued in International Application No. PCT/JP2012/052035 (with translation).

Jul. 31, 2013 Notice of Reasons for Rejection issued in Japanese Patent Application No. 2012-017070 (with English translation).

* cited by examiner

CUT-SHEET FEEDER

TECHNICAL FIELD

The present invention relates to a cut-sheet feeder which sequentially draws and feeds a cut sheet from a stack of cut sheets with one placed on another.

BACKGROUND ART

Conventionally known as a cut-sheet feeder of this type is one which brings a feed belt into rotational contact with the lower end of a stack of cut sheets while the rear end portion of the stack of cut sheets is being lifted up by an inclined guide member having a frontward inclined upper surface (e.g., Patent Document 1).

PRIOR ART DOCUMENT

Patent Document

Patent Document 1: Japanese Published Unexamined Patent Application No. 2010-168201 (FIG. 1)

SUMMARY OF THE INVENTION

Problem to be Overcome by the Invention

However, the aforementioned conventional cut-sheet feeder would tend to cause a problem, so-called "partial double feeding" that the rear end portion of one cut sheet drawn in ahead from a stack of cut sheets overlapped the front end portion of the subsequent cut sheet when being fed.

The present invention was developed in view of the aforementioned problem. It is therefore an object of the invention to provide a cut-sheet feeder which is capable of reducing the occurrence of partial double feeding than the conventional ones.

Means for Overcoming the Problem

As will be described below, the inventor of the present application figured out the mechanism of partial double feeding which had not been clarified in the past. That is, as the lowermost cut sheet in a stack of cut sheets (hereinafter to be referred to as the "first cut sheet") is drawn by a feed belt, the contact area between the cut sheet next to the first cut sheet (hereinafter to be referred to as the "second cut sheet") and the feed belt increases. This causes an increase in the kinetic friction force which the second cut sheet receives from the feed belt. Then, partial double feeding occurs when the kinetic friction force acting between the second cut sheet and the feed belt becomes greater than the static friction force acting between the second cut sheet and the cut sheet next to the second cut sheet before the first cut sheet is completely drawn. Thus, if the contact area between the second cut sheet and the feed belt is set so that the kinetic friction force acting between the second cut sheet and the feed belt becomes greater than the static friction force acting between the second cut sheet and the cut sheet next to the second cut sheet when the first cut sheet is completely drawn, it is made possible to prevent the so-called partial double feeding in which the second cut sheet starts to be fed before the first cut sheet is completely drawn, so that the cut sheets partially overlap each other when being fed.

In this context, the inventor of the present application has reached the finding that another member can be provided separately from the inclined guide member in order to adjust the contact area between the cut sheet and the feed belt, thereby reducing the occurrence of partial double feeding or easily resolving the partial double feeding even in the case of occurrence of the partial double feeding. This finding has led to the inventions according to claims 1 to 10 as described below.

That is, the cut-sheet feeder according to the invention of claim 1 brings a feed belt into rotational contact with the lowermost cut sheet of a stack of cut sheets, one stacked on another, and draws and feeds the lowermost cut sheet sequentially from the stack of cut sheets in the forward direction of feeding of cut sheets. The cut-sheet feeder includes a belt contact amount adjuster disposed below the stack of cut sheets, and while a rear portion of the lowermost cut sheet of the stack of cut sheets from an intermediate position in the direction of feeding of cut sheets is lifted off the feed belt, supporting a front portion from the intermediate position rotationally contactably with the feed belt. The cut-sheet feeder further includes an inclined guide member disposed below the rear end portion of the stack of cut sheets and protruded above the belt contact amount adjuster. The inclined guide member also has a guide surface which is inclined forwardly downward and which shifts the plurality of cut sheets included in the stack of cut sheets along the guide surface in the direction of feeding of cut sheets. The cut-sheet feeder also includes an inclined guide member variable support mechanism capable of moving and fixing the inclined guide member at a given position in the direction of feeding of cut sheets, and a belt contact amount adjusting mechanism capable of moving separately from the inclined guide member and of fixing the belt contact amount adjuster at a given position in the direction of feeding of cut sheets.

The invention of claim 2 is the cut-sheet feeder according to claim 1, which includes a hand-over inclined surface inclined forwardly downward and formed at the front end portion of a section of the upper surface of the belt contact amount adjuster, where the section is located above the rotational contact surface of the feed belt with the cut sheet.

The invention of claim 3 is the cut-sheet feeder according to claim 2, which includes a cut-sheet main support surface formed on a section of the upper surface of the belt contact amount adjuster and formed at a smaller angle of inclination with respect to a horizontal plane than the hand-over inclined surface, where the section is more rearward than the hand-over inclined surface.

The invention of claim 4 is the cut-sheet feeder according to claim 1, wherein the belt contact amount adjuster is configured such that the entirety of a section to be brought into contact with the stack of cut sheets is a flat surface which is inclined forwardly downward.

The invention of claim 5 is the cut-sheet feeder according to any one of claims 1 to 4, which includes a hand-over projection provided on the belt contact amount adjuster and disposed to a side of the feed belt. The hand-over projection is inclined such that the upper surface of a front end portion is located below a rotational contact surface of the feed belt with the cut sheet and the upper surface of a rear end portion is located above the rotational contact surface. The cut-sheet feeder further includes a hand-over section configured to have the hand-over projection disposed between a pair of the feed belts or to have the feed belt disposed between a pair of the hand-over projections.

The invention of claim 6 is the cut-sheet feeder according to claim 5, wherein the belt contact amount adjuster has a cover section to cover the feed belt from above and has the hand-over projection protruded from the front end of the cover section.

The invention of claim 7 is the cut-sheet feeder according to any one of claims 1 to 6, wherein the belt contact amount adjusting mechanism includes a first guide for supporting the belt contact amount adjuster linearly movably in the direction of feeding of cut sheets, and a first fixing part capable of fixing the belt contact amount adjuster at a given position along the first guide.

The invention of claim 8 is the cut-sheet feeder according to claim 7, wherein the first fixing part includes the following: a plurality of first locking sections formed along the longitudinal direction of the first guide; a first locking pawl provided on the belt contact amount adjuster and being capable of reciprocating between a first locking position at which the first locking pawl is locked with a given one of the first locking sections and a first release position at which the engagement with the first locking section is released; and a first spring for retaining the first locking pawl at the first locking position.

The invention of claim 9 is the cut-sheet feeder according to any one of claims 1 to 8, wherein the inclined guide member variable support mechanism includes the following: a second guide for supporting the inclined guide member linearly movably in the direction of feeding of cut sheets; and a second fixing part capable of fixing the inclined guide member at a given position along the second guide.

The invention of claim 10 is the cut-sheet feeder according to claim 9, wherein the second fixing part includes the following: a plurality of second locking sections formed along the longitudinal direction of the second guide; a second locking pawl provided on the inclined guide member and being capable of reciprocating between a second locking position at which the second locking pawl is locked with a given one of the second locking sections and a second release position at which the engagement with the second locking section is released; and a second spring for retaining the second locking pawl at the second locking position.

Effects of the Invention

The cut-sheet feeder according to the invention of claim 1 includes the belt contact amount adjuster which allows a rear portion of the lowermost cut sheet of the stack of cut sheets from an intermediate position in the direction of feeding of cut sheets to be lifted off the feed belt and which allows a front portion from the intermediate position to be supported in rotational contact with the feed belt. Furthermore, the belt contact amount adjusting mechanism is capable of varying the position of the belt contact amount adjuster in the direction of feeding of cut sheets so as to adjust the contact area between the feed belt and the stack of cut sheets. This makes it possible to reduce the occurrence of partial double feeding than before. Furthermore, it is also possible to assist in reducing the occurrence of partial double feeding by allowing the inclined guide member to spread lower end portions of the stack of cut sheets so as to be shifted forward along the guide surface. In addition, since the position of the inclined guide member can be varied in the direction of feeding of cut sheets, it is possible to accommodate changes in the size of the cut sheets. Furthermore, since the present invention allows the positions of the belt contact amount adjuster and the inclined guide member to be varied separately, the contact area between the stack of cut sheets and the feed belt can be varied with the inclined guide member kept fixed at a position depending on the size of the cut sheets.

Here, the belt contact amount adjuster may also be made up of a horizontal flat plate, or alternatively, as in the invention of claim 2, may be adapted such that the hand-over inclined surface inclined forwardly downward is formed at the front end portion of a section of the upper surface of the belt contact amount adjuster, the section being located above the rotational contact surface of the feed belt with the cut sheet. According to the configuration of the invention of claim 2, when the cut sheet is drawn from the stack of cut sheets, it is possible to smoothly hand over the rear portion of the cut sheet supported by the belt contact amount adjuster to the feed belt.

Furthermore, in the invention of claim 2, the belt contact amount adjuster may be adapted such that the upper surface of a section more rearward than the hand-over inclined surface may have a smaller angle of inclination with respect to a horizontal plane than the hand-over inclined surface (the invention of claim 3). The belt contact amount adjuster may also be adapted such that the upper surface of a section more rearward than the hand-over inclined surface is flush with the hand-over inclined surface, that is, the entirety of a section of the upper surface of the belt contact amount adjuster is inclined forwardly downward, the section being in contact with the stack of cut sheets (the invention of claim 4). Note that according to the configuration of the invention of claim 3, the belt contact amount adjuster is capable of supporting the stack of cut sheets with stability.

Furthermore, as in the invention of claim 5, the cut-sheet feeder may include the hand-over projection which is inclined such that the upper surface of the front end portion is located below the rotational contact surface of the feed belt with the cut sheet, and meanwhile the upper surface of the rear end portion is located above the rotational contact surface. This configuration allows for eliminating a height difference on the cut sheet hand-over section between the upper surface of the hand-over projection and the rotational contact surface of the feed belt, thereby preventing the cut sheet from being folded. Note that a configuration with a plurality of feed belts and a plurality of hand-over projections alternately disposed is included in the configuration in which a hand-over projection is disposed between a pair of feed belts or in the configuration in which a feed belt is disposed between a pair of hand-over projections.

Furthermore, the belt contact amount adjuster may be adapted to have a plurality of strip plate members spaced apart from each other and aligned side by side, the strip plate members being coupled to each other. Or alternatively, as in the invention of claim 6, the belt contact amount adjuster may also be adapted to have a cover section to cover the feed belt from above with the hand-over projection protruded from the front end of the cover section. According to the invention of claim 6, the belt contact amount adjuster serves to support the stack of cut sheets with stability.

The belt contact amount adjusting mechanism may include a magnet for coupling between a base member for supporting the belt contact amount adjuster and the belt contact amount adjuster, or alternatively, a clamp for clamping the belt contact amount adjuster and the base member. Furthermore, as in the invention of claim 7, the belt contact amount adjusting mechanism may also include the first guide for supporting the belt contact amount adjuster linearly movably in the direction of feeding of cut sheets, and the first fixing part capable of fixing the belt contact amount adjuster at a given position along the first guide. More specifically, the belt contact amount adjusting mechanism may include a rack and pinion mechanism with the rack as the first guide and the pinion as the first fixing part. Or alternatively, the belt contact amount adjusting mechanism may also include a ball screw mechanism with the ball screw as the first guide and the ball nut as the first fixing part. On the other hand, as in the invention of claim 8, the first fixing part may include the following: a plurality of first locking sections formed along the longitudinal direction of the first guide; a first locking pawl provided on the belt contact amount adjuster and being capable of reciprocating between a first locking position at which the first locking pawl is locked with a given one of the first locking sections and a first release position at which the engagement with the first locking section is released; and a first spring for retaining the first locking pawl at the first locking position. Note that according to the invention of claim 7, the belt contact amount adjuster can be linearly moved with stability in the direction of feeding of cut sheets.

The inclined guide member variable support mechanism may also be configured in the same manner as the belt contact amount adjusting mechanism (the inventions of claims 9 and 10). Note that according to the invention of claim 9, the inclined guide member can be linearly moved with stability in the direction of feeding of cut sheets.

BEST MODE FOR CARRYING OUT THE INVENTION

First Embodiment

Figure 1:
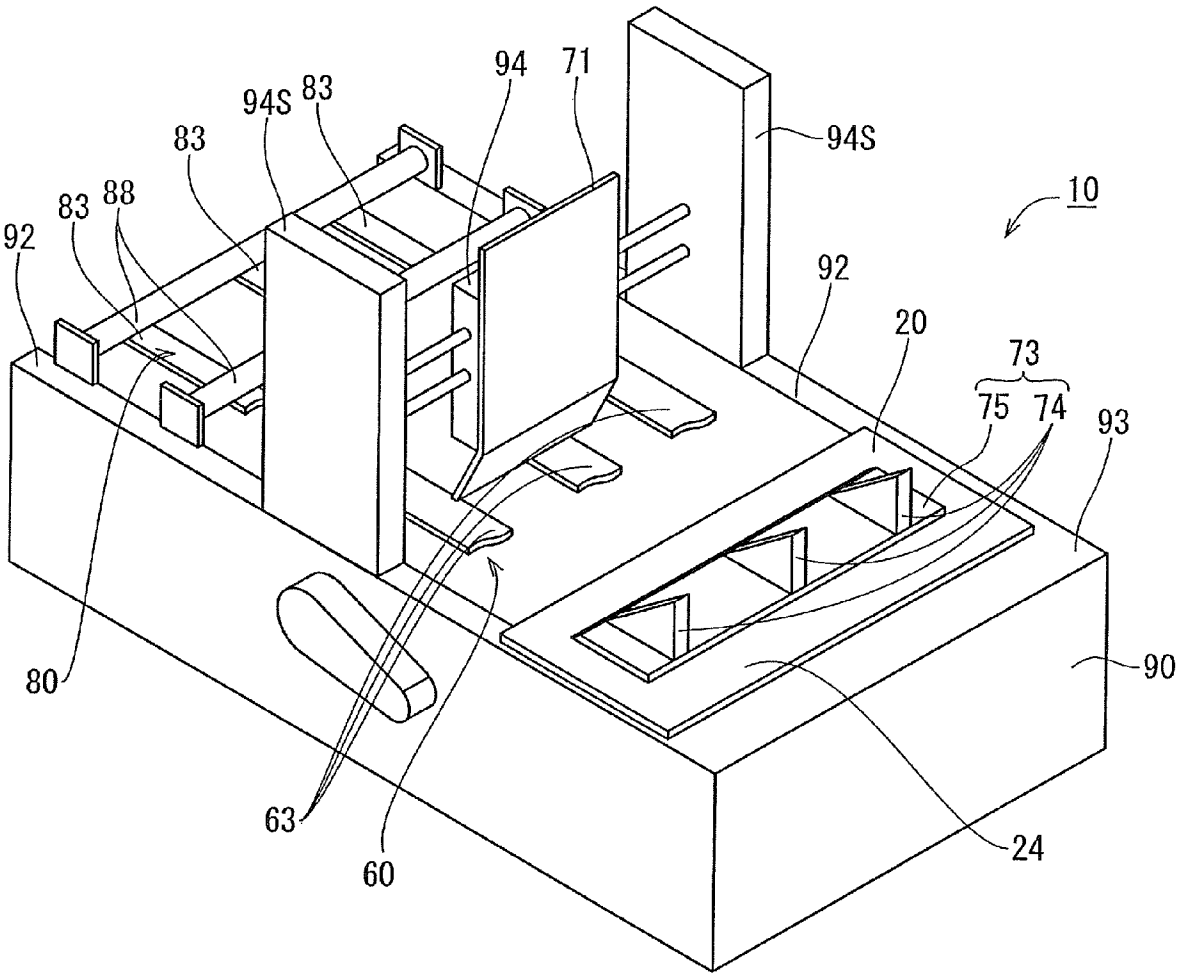
FIG. 1 is a perspective rear view illustrating a cut-sheet feeder according to a first embodiment.

Hereinafter, a description will be made of a first embodiment of the present invention with reference to FIGS. 1 to 6. As shown in FIG. 1, a cut-sheet feeder 10 according to the present invention has various types of parts disposed on a base frame 90. The base frame 90, which is formed as a whole in the shape of a box, includes side plates 92 and 92 opposed to each other in the horizontal direction and an upper surface plate 93 for coupling between the rear end portions of the side plates 92. Note that the upper surface plate 93 is in parallel to the horizontal plane.

At the substantial center of the side plates 92 and 92 in the back-and-forth direction, side walls 94S and 94S stand upright. At a position sandwiched between those side walls 94S and 94S, there is provided a parts mounting unit 94. Provided behind the parts mounting unit 94 is a stock unit 70 in which a stack of cut sheets G can be placed with a plurality of cut sheets S stacked on top of another in the up-and-down direction (see FIG. 2). Note that in the drawings to be herein referred to, the thickness of the cut sheet S and the gap between the cut sheets S in the stack of cut sheets G are exaggerated for the purpose of illustration.

Figure 2:
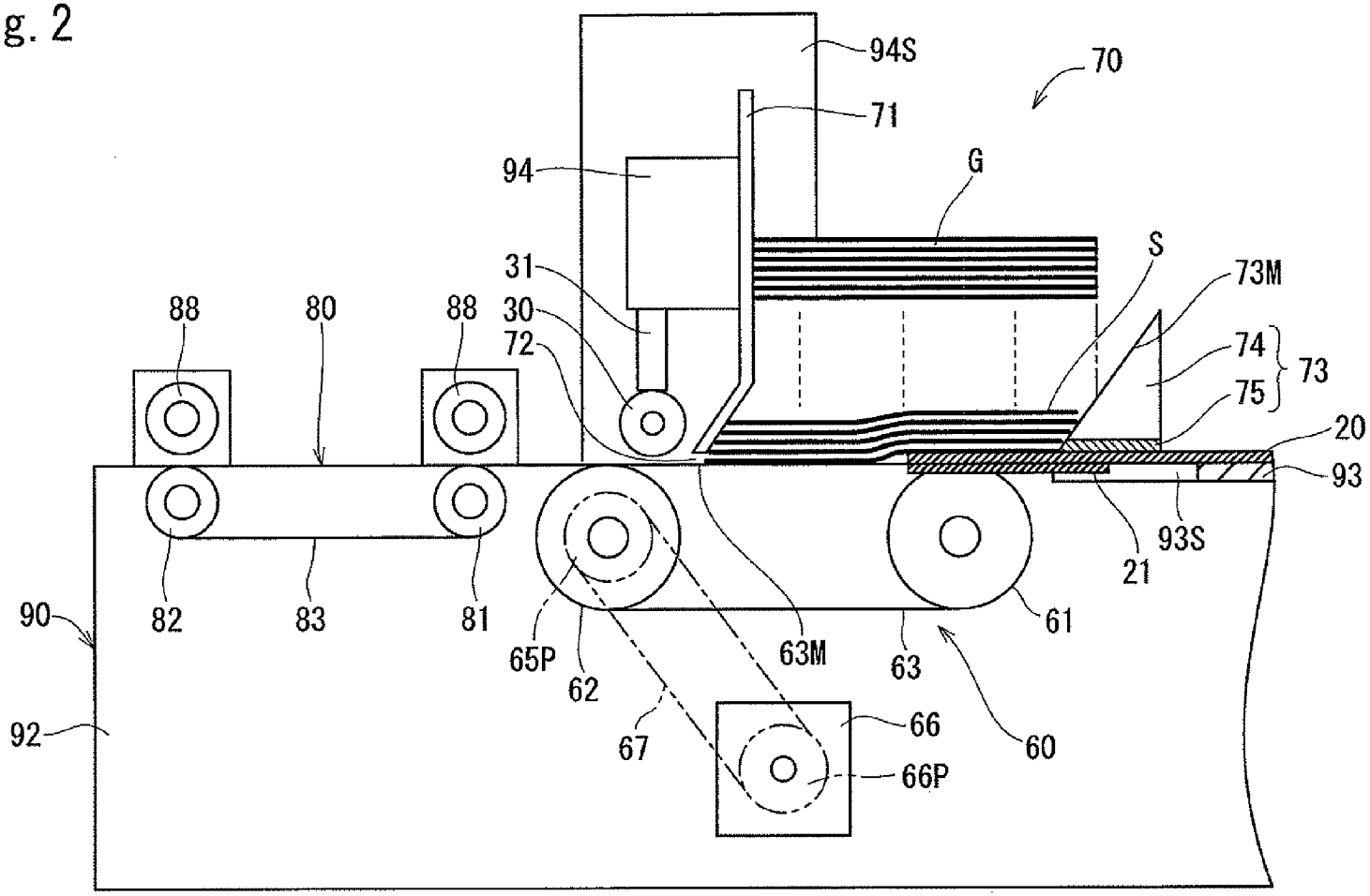
FIG. 2 is a sectional side view illustrating a feed belt and a stack of cut sheets.

As shown in FIG. 2, the stock unit 70 has a front end wall 71 in contact with the rear surface of the parts mounting unit 94. The front end wall 71 is substantially perpendicular to the upper surface plate 93 and has the lower end portion extending forward. Between the lower edge of the front end wall 71 and a belt feed part 60 to be discussed later, there is formed a cut-sheet ejection port 72 through which the cut sheet S can pass.

Behind the stock unit 70, there is provided an inclined guide member 73. The inclined guide member 73 is integrated with a plurality of triangular plates 74 aligned in the direction of the width of the base frame 90 (in the direction of the side plates 92 and 92 being opposed to each other) and a mounting plate 75 for fixing the triangular plates 74 to the upper surface plate 93 (see FIG. 1). When viewed from a side, the triangular plates 74 have the shape of a right-angled triangle with a forwardly declining hypotenuse, so that the inclined surface is in contact with the rear end edge of a plurality of cut sheets S of those placed in the stock unit 70, the plurality of cut sheets S being located on the lower end side. This allows the lower cut sheets S of those stacked on top of another to be shifted forward relative to the upper cut sheets S. Note that the inclined surface of the triangular plates 74 serves as a guide surface 73M of the present invention.

Figure 6:
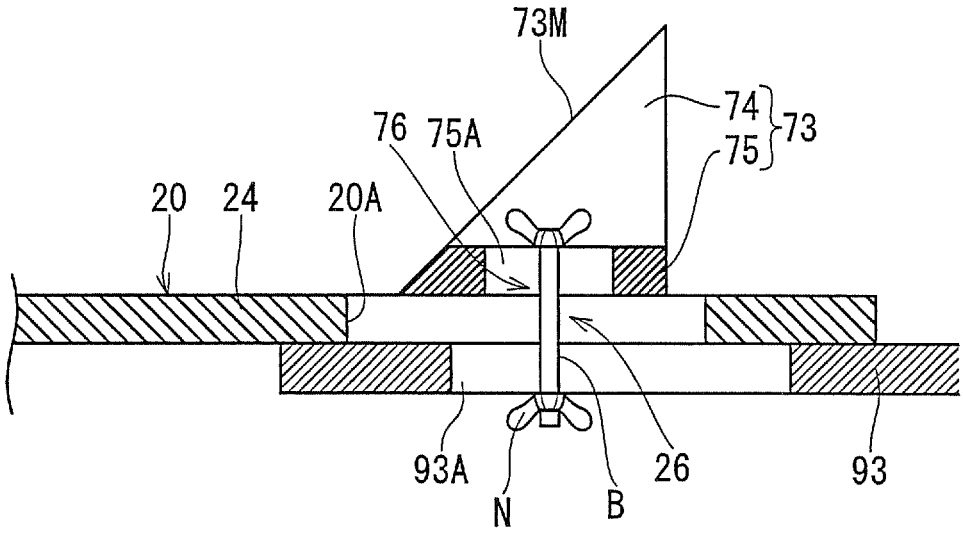
FIG. 6 is a sectional side view illustrating a belt contact amount adjuster and an inclined guide member.

As shown in FIG. 6, the mounting plate 75 has a second elongated guide hole 75A which extends in the back-and-forth direction and penetrates therethrough. Furthermore, as illustrated in the same figure, the upper surface plate 93 also has an elongated base hole 93A which extends in the back-and-forth direction and penetrates therethrough. With the second elongated guide hole 75A and the elongated base hole 93A overlapping each other, a bolt B penetrating through the second elongated guide hole 75A and the elongated base hole 93A is fastened with a nut N, thereby allowing the inclined guide member 73 to be fixed to the upper surface plate 93. By loosening the bolt B, the position of the inclined guide member 73 in the back-and-forth direction can be varied along the second elongated guide hole 75A and the elongated base hole 93A, and thus the position of the inclined guide member 73 can be selectively adjusted in the back-and-forth direction depending on the size of the cut sheet S.

As shown in FIG. 2, provided below the stock unit 70 is the belt feed part 60 which draws forwardly and slidingly feeds the plurality of cut sheets S placed in the stock unit 70 sequentially from the lower end side. Specifically, there are provided feed belts 63 which are each stretched over a rear pulley 61 disposed immediately below the stock unit 70 and a front pulley 62 disposed at a forward position relative to the stock unit 70. The plurality of feed belts 63, which are identical to each other, are disposed to be in parallel to each other in the width direction of the base frame 90.

More specifically, between the pair of side plates 92 and 92 of the base frame 90, a rear shaft 64 and a front shaft are interposed which are parallel to each other and horizontally aligned. The rear shaft 64 and the front shaft 65 are pivotally supported at both ends thereof with bearings (not shown) in the side plates 92 and 92. The rear shaft 64 has the plurality of rear pulleys 61 pivotally supported so as to be spaced from each other, while the front shaft 65 has the same number of front pulleys 62 as that of the rear pulleys 61 pivotally supported so as to be spaced from each other. Furthermore, the respective feed belt 63 is stretched over the rear pulley 61 and the front pulley 62 which are aligned in the back-and-forth direction.

The feed belt 63 is adapted to be brought into frictional contact with the lower surface of the lowermost cut sheet S of the stack of cut sheets G placed in the stock unit 70, thereby drawing the lowermost cut sheet S through the cut-sheet ejection port 72 of the stock unit 70 so as to slidingly feed forward the cut sheet S. Note that the feed belt 63 has an upwardly oriented surface which serves as a rotational contact surface 63M in contact with the cut sheet S, and the rotational contact surface 63M is disposed in parallel to the upper surface plate 93.

The feed belt 63 is driven by a servomotor 66 disposed under the upper surface plate 93. That is, an output pulley 66P is fixed to the output shaft (not shown) coupled to a rotor of the servomotor 66, while a driving pulley 65P is fixed to one end portion of the front shaft 65 which penetrates one of the side plates 92. Moreover, a timing belt 67 is stretched over the output pulley 66P and the driving pulley 65P. Note that the tension of the timing belt 67 can be adjusted by a tension roller (not shown).

At a position spaced apart forwardly from the cut-sheet ejection port 72 of the stock unit 70, there is provided a double-feed restrictor 30. The double-feed restrictor 30 is vertically movably supported by a support member 31 mounted to the front end portion of the parts mounting unit 94. The double-feed restrictor 30 is also biased downward by a compression coil spring (not shown). Moreover, the cut sheet S drawn from the stock unit 70 by rotation of the feed belt 63 pushes up the double-feed restrictor 30 so as to pass through between the double-feed restrictor 30 and the feed belt 63.

At the forward section than the double-feed restrictor 30, there is provided a downstream belt feed part 80 for allowing the cut sheet S discharged through the cut-sheet ejection port 72 to be fed further in the forward direction. The downstream feed belt part 80 is configured in the same manner as the belt feed part 60, so that a plurality of downstream feed belts 83 are each stretched over a downstream rear pulley 81 and a downstream front pulley 82. The downstream feed belts 83, which are identical to each other, are disposed in parallel to each other in the width direction of the base frame 90 (see FIG. 3). Note that the downstream feed belt 83 is also provided with an upwardly oriented transport surface which is adapted to be flush with the upper surface of the upper surface plate 93.

Between the side plates 92 and 92, a downstream rear shaft 84 and a downstream front shaft 85 which are parallel to each other and horizontally aligned are pivotally supported. The plurality of downstream front pulleys 82 and the plurality of downstream rear pulleys 81 are pivotally supported on the downstream front shaft 85 and the downstream rear shaft 84, respectively, so as to be spaced from each other. Moreover, the respective downstream feed belt 83 is stretched over the downstream rear pulley 81 and the downstream front pulley 82 aligned in the back-and-forth direction.

The downstream rear shaft 84 is coupled to the front shaft 65 of the aforementioned belt feed part 60. Specifically, there is a coupling belt 87 stretched over a downstream coupling pulley 86 pivotally supported on the downstream rear shaft 84 and a coupling pulley 69 pivotally supported on the front shaft 65. This allows the downstream feed belt 83 to rotate by receiving a drive force form the servomotor 66.

Figure 3:
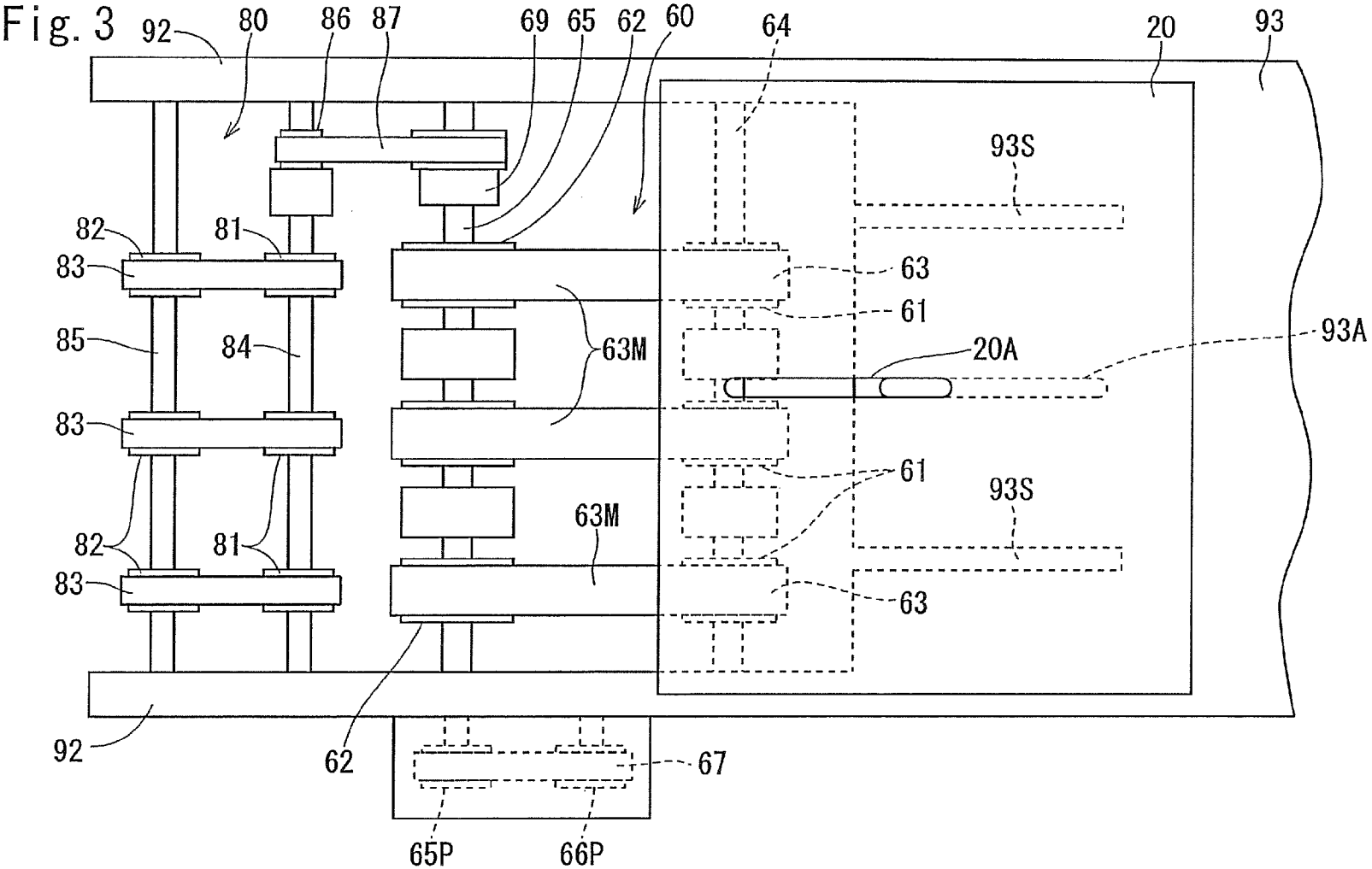
FIG. 3 is a plan view illustrating a belt contact amount adjuster.

Here, the coupling pulley 69 and the downstream coupling pulley 86 have the same diameter at one axial end side (the lower side in FIG. 3), so that when the coupling belt 87 is stretched over the coupling pulley 69 and the downstream coupling pulley 86 on the one end side, the feed speed of the downstream feed belt 83 becomes the same as the feed speed of the feed belt 63. On the other hand, the other axial end side of the coupling pulley 69 (the upper side in FIG. 3) is greater in diameter than the one end side and the other axial end side of the downstream coupling pulley 86 is less in diameter than the one end. Thus, when the coupling belt 87 is stretched over the coupling pulley 69 and the downstream coupling pulley 86 on the other end side (which is illustrated in FIG. 3), the feed speed of the downstream feed belt 83 becomes greater than that of the feed belt 63.

The downstream feed belt 83 is configured to be brought into frictional contact with the lower surface of the cut sheet S discharged through the cut-sheet ejection port 72 of the stock unit 70, thereby further feeding the discharged cut sheet S in the forward direction.

Furthermore, above the downstream belt feed part 80, a plurality of press rollers 88 are rotatably and pivotally supported so as to press, from above, the cut sheet S being fed by the downstream feed belt 83.

The cut-sheet feeder 10 of this embodiment is provided on the upper surface plate 93 with a belt contact amount adjuster 20 which is slidable in the back-and-forth direction. The belt contact amount adjuster 20 is horizontal plate-shaped and aligned in parallel to the rotational contact surface 63M of the feed belt 63. The belt contact amount adjuster 20 pushes up the rear portion of the lowermost cut sheet of the stack of cut sheets G off the feed belt 63, and supports the front portion of the lowermost cut sheet of the stack of cut sheets G rotationally contactably with the feed belt 63.

As shown in FIG. 3, the belt contact amount adjuster 20 has a first elongated guide hole 20A which extends in the back-and-forth direction and penetrates therethrough. Then, with the first elongated guide hole 20A and the elongated base hole 93A of the upper surface plate 93 overlapping each other, the nut N is fastened to the bolt B which penetrates through the first elongated guide hole 20A and the elongated base hole 93A, thereby fixing the belt contact amount adjuster 20 to the upper surface plate 93. By loosening the bolt B, the position of the belt contact amount adjuster 20 can be varied in the back-and-forth direction along the first elongated guide hole 20A and the elongated base hole 93A. Note that there is a slight gap formed between the belt contact amount adjuster 20 and the feed belt 63 so as to prevent the belt contact amount adjuster 20 from being brought into contact with the feed belt 63 (see FIG. 5C).

More specifically, the belt contact amount adjuster 20 is sandwiched between the mounting plate 75 of the inclined guide member 73 and the upper surface plate 93. The belt contact amount adjuster 20 is fixed to the upper surface plate 93 by screwing the bolt B into the nut N so as to fix the mounting plate 75 and the upper surface plate 93 together, with the elongated base hole 93A of the upper surface plate 93, the first elongated guide hole 20A of the belt contact amount adjuster 20, and the second elongated guide hole 75A of the mounting plate 75 overlapping each other.

Figure 4:
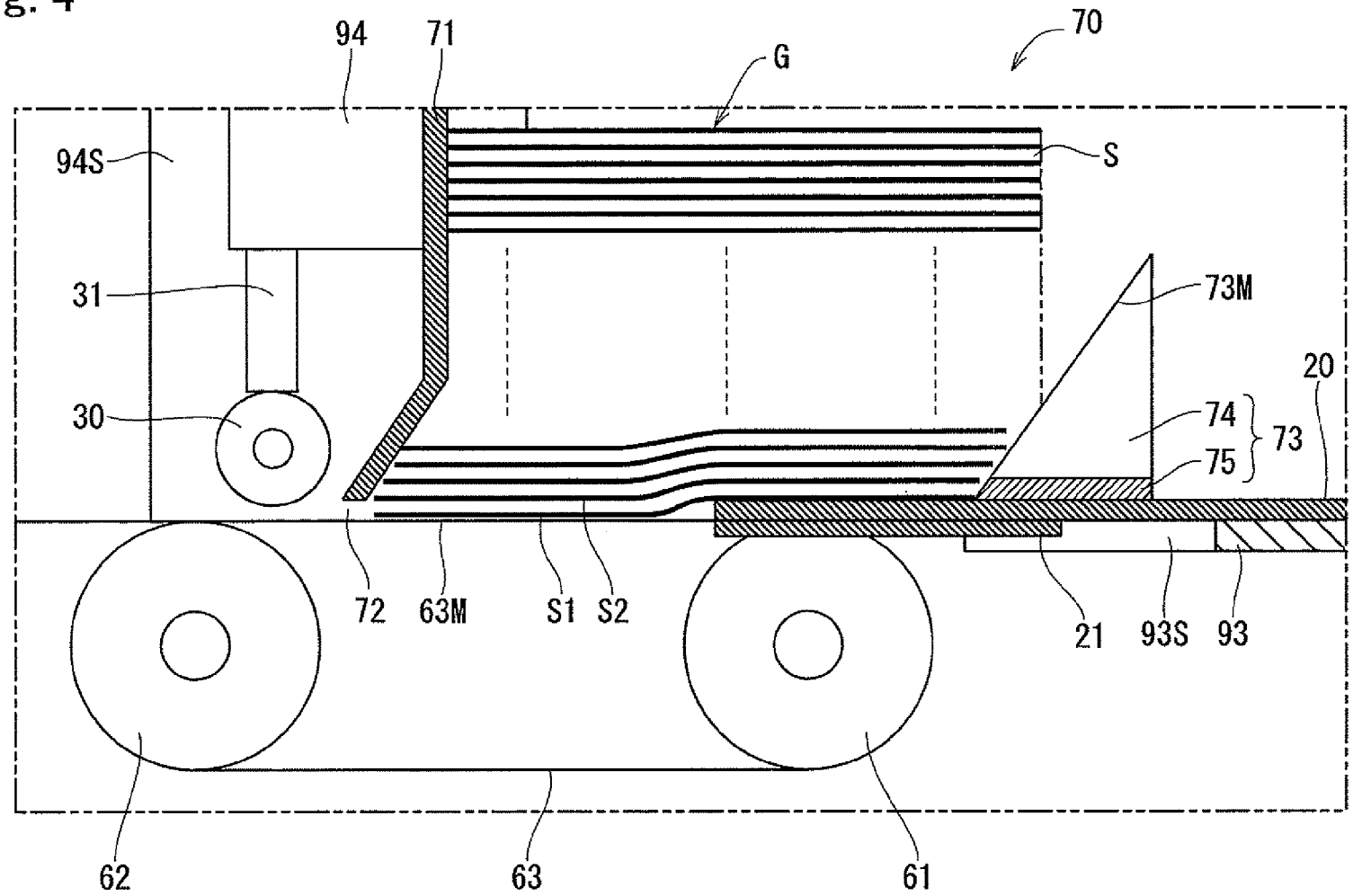
FIG. 4 is a sectional side view illustrating a stack of cut sheets and the surrounding thereof.

Furthermore, as shown in FIG. 4, the belt contact amount adjuster 20 is provided on the lower surface thereof with engaging project ions 21 and 21 which extend in the back-and-forth direction (only one of the engaging projections 21 is illustrated in FIG. 4). The engaging projections 21 and 21 are engaged with slits 93S and 93S which are formed rearwardly from the front end portion of the upper surface plate 93 (see FIG. 3) so as to restrict movement of the belt contact amount adjuster 20 in the width direction (in the vertical direction of FIG. 3).

Here, in this embodiment, the first elongated guide hole 20A serves as the "first guide" of the present invention, while the second elongated guide hole 75A serves as the "second guide." Furthermore, the bolt B and the nut N constitute the "first fixing part" and the "second fixing part" of the present invention. Then, the second elongated guide hole 75A, the bolt B, and the nut N constitute an inclined guide member variable support mechanism 76 of the present invention, while the first elongated guide hole 20A, the bolt B, and the nut N constitute a belt contact amount adjusting mechanism 26 of the present invention.

Figure 5A:
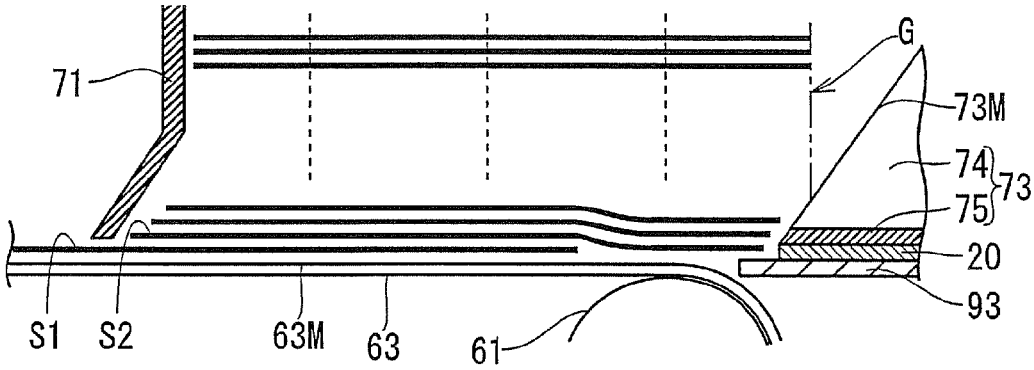
FIG. 5A is an explanatory sectional side view illustrating the operation of a cut-sheet feeder.
Figure 5B:
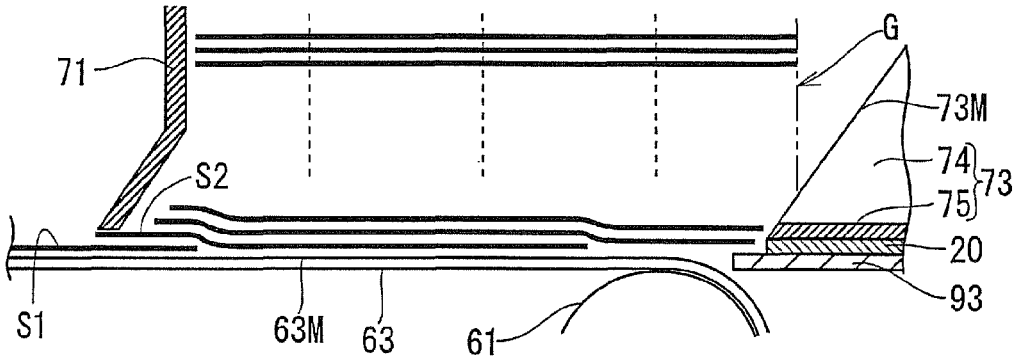
FIG. 5B is an explanatory sectional side view illustrating the operation of a cut-sheet feeder.

Next, a description will be made of the operation and effects of the cut-sheet feeder 10. To use the cut-sheet feeder 10, first, the back-and-forth positions of the belt contact amount adjuster 20 and the inclined guide member 73 are adjusted, and then cut sheets S to be fed are set by stacking on top of another in the stock unit 70. FIG. 5A shows the case where the front end of the belt contact amount adjuster 20 is disposed near the rear end of the stack of cut sheets G. At this time, the rear end of the lower end portions of the stack of cut sheets G is supported on the inclined guide surface 73M of the inclined guide member 73 in a manner such that the cut sheets S located at the lower end portion of the stack of cut sheets G are shifted forward as moving downwardly. Furthermore, the section of the stack of cut sheets G more frontward than the section supported by the inclined guide member 73 is supported by the belt contact amount adjuster 20, while the section of the stack of cut sheets G more frontward than the section supported by the belt contact amount adjuster 20 is in contact with the feed belt 63. Here, the belt contact amount adjuster 20 has a horizontal upper surface which enables stable supporting of the stack of cut sheets G.

After the cut sheets S are set, the feed belt 63 is rotationally driven and then the rotational contact surface 63M of the feed belt 63 is brought into frictional contact with the lower surface of a first cut sheet S1 located at the lowermost section of the stack of cut sheets G, so that the first cut sheet S1 moves forward from the stock unit 70 through the cut-sheet election port 72.

When the first cut sheet S1 moves forward, the lower surface of the rear end portion of a second cut sheet S2 located immediately above the first cut sheet S1 is exposed, so that the lower surface of the second cut sheet S2 is brought into contact with the rotational contact surface 63M of the feed belt 63. As the first cut sheet S1 moves, an increase in the contact area between the second cut sheet S2 and the feed belt 63 leads to an increase in the kinetic friction force received by the second cut sheet S2 from the feed belt 63. Then, when the first cut sheet S1 has been completely drawn from the stack of cut sheets G, the kinetic friction force received by the second cut sheet S2 from the feed belt 63 also becomes greater than the static friction force between the second cut sheet S2 and a third cut sheet S3 on top of the second cut sheet, allowing the second cut sheet S2 to start to be fed. As a result, the cut sheets S are sequentially fed forward from the lower end side of the stack of cut sheets G.

Here, for example, suppose that the cut sheet S has a high friction coefficient. In this case, such a situation could occur in which the kinetic friction force received by the second cut sheet S2 from the feed belt 63 becomes greater than the static friction force between the second cut sheet S2 and the third cut sheet S3 before the first cut sheet S1 is completely drawn from the stack of cut sheets G, thereby causing the second cut sheet S2 to start to be fed (see FIG. 5B). In such a case, as can be seen from the changes in FIG. 5A to FIG. 5C, the front end of the belt contact amount adjuster 20 is slid forward further than the rear end of the stack of cut sheets G. At this time, since the engaging projection 21 of the belt contact amount adjuster 20 is engaged with the slit 93S of the upper surface plate 93, the belt contact amount adjuster 20 moves with stability.

Figure 5C:
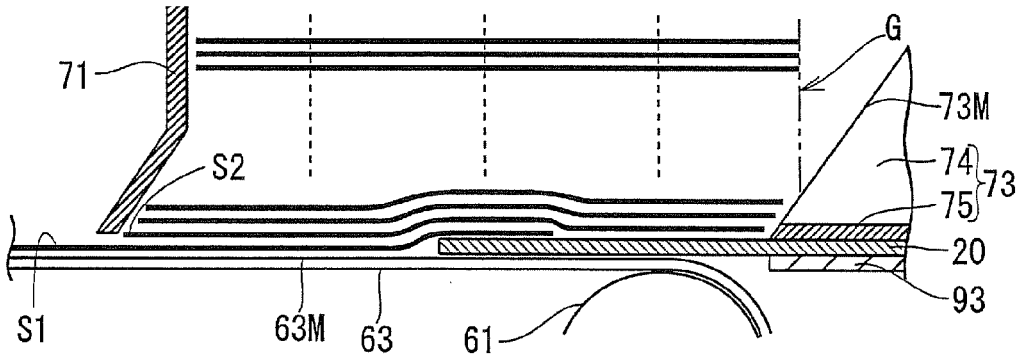
FIG. 5C is an explanatory sectional side view illustrating the operation of a cut-sheet feeder.
Figure 5D:
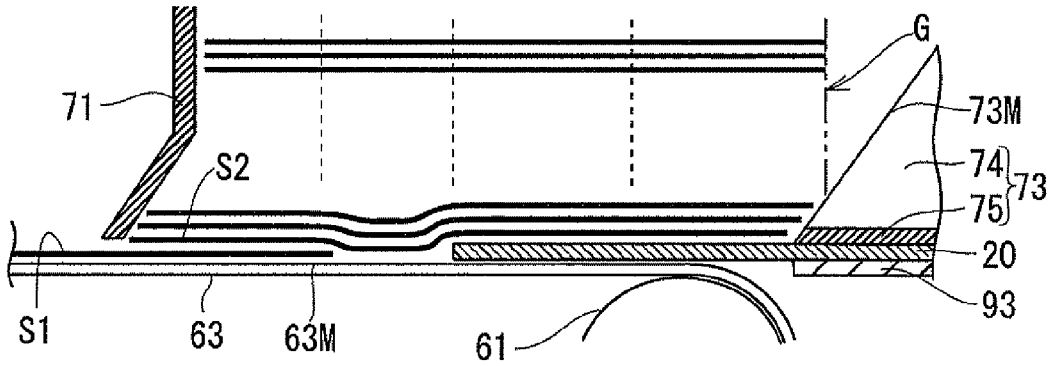
FIG. 5D is an explanatory sectional side view illustrating the operation of a cut-sheet feeder.

As shown in FIG. 5C, the belt contact amount adjuster 20 disposed forward causes the contact between the rear end portion of the lower surface of the second cut sheet S2 and the feed belt 63 to be prevented by the belt contact amount adjuster 20 when the first cut sheet S1 moves forward due to the frictional contact with the feed belt 63. This will make the contact area between the second cut sheet S2 and the feed belt 63 less than that shown in FIG. 5B (see FIG. 5D). Thereby, it is made possible to reduce the kinetic friction force produced between the second cut sheet S2 and the feed belt 63, so that when the first cut sheet S1 has been completely drawn from the stack of cut sheets G, the second cut sheet S2 can start to be fed. That is, the partial double feeding of the cut sheet S can be resolved.

Here, note that the upper surface of the belt contact amount adjuster 20 is horizontal and has a smaller angle of inclination with respect to the horizontal plane than the guide surface 73M of the inclined guide member 73. When compared with the case where the inclined guide member 73 is moved to change the contact area, this prevents the rear side of the stack of cut sheets G from being lifted up, so that the belt contact amount adjuster 20 can be adjusted with ease to such a position as to be capable of resolving the partial double feeding of the cut sheet S.

The cut sheet S drawn from the stock unit 70 enters into between the double-feed restrictor 30 and the feed belt 63 and passes therethrough while pushing up the double-feed restrictor 30 so as to be further fed in the forward direction by the downstream feed belt 83. Here, the feed speed of the downstream feed belt 83 can be made higher than the feed speed of the feed belt 63. Thus, even if cut sheet S is partially overlapped when drawn out of the stack of cut sheets G, the overlap can be resolved.

As described above, the cut-sheet feeder 10 of this embodiment allows the belt contact amount adjusting mechanism 26 to vary the position of the belt contact amount adjuster 20 in the direction of feeding of cut sheets so as to adjust the contact area between the feed belt 63 and the stack of cut sheets G. Thus, the partial double feeding can be prevented, or even if not, the overlap amount between the cut sheets S can be reduced to such an extent that the overlap between the cut sheets S can be resolved later in post processing. It is therefore possible to reduce the occurrence of partial double feeding when compared with before. It is also possible to allow the inclined guide member 73 to shift forward the cut sheet S located at the lower end portion of the stack of cut sheets G, thereby assisting in reducing the occurrence of partial double feeding. In addition, since the inclined guide member 73 can vary its position in the direction of feeding of cut sheets by the inclined guide member variable support mechanism 76, changes in the size of the cut sheet S can be accommodated. Furthermore, since this embodiment allows the positions of the belt contact amount adjuster 20 and the inclined guide member 73 to be varied separately, the contact area between the cut sheet S and the feed belt 63 can be varied with the inclined guide member 73 kept fixed at a position depending on the size of the cut sheets S.

Second Embodiment

Figure 7:
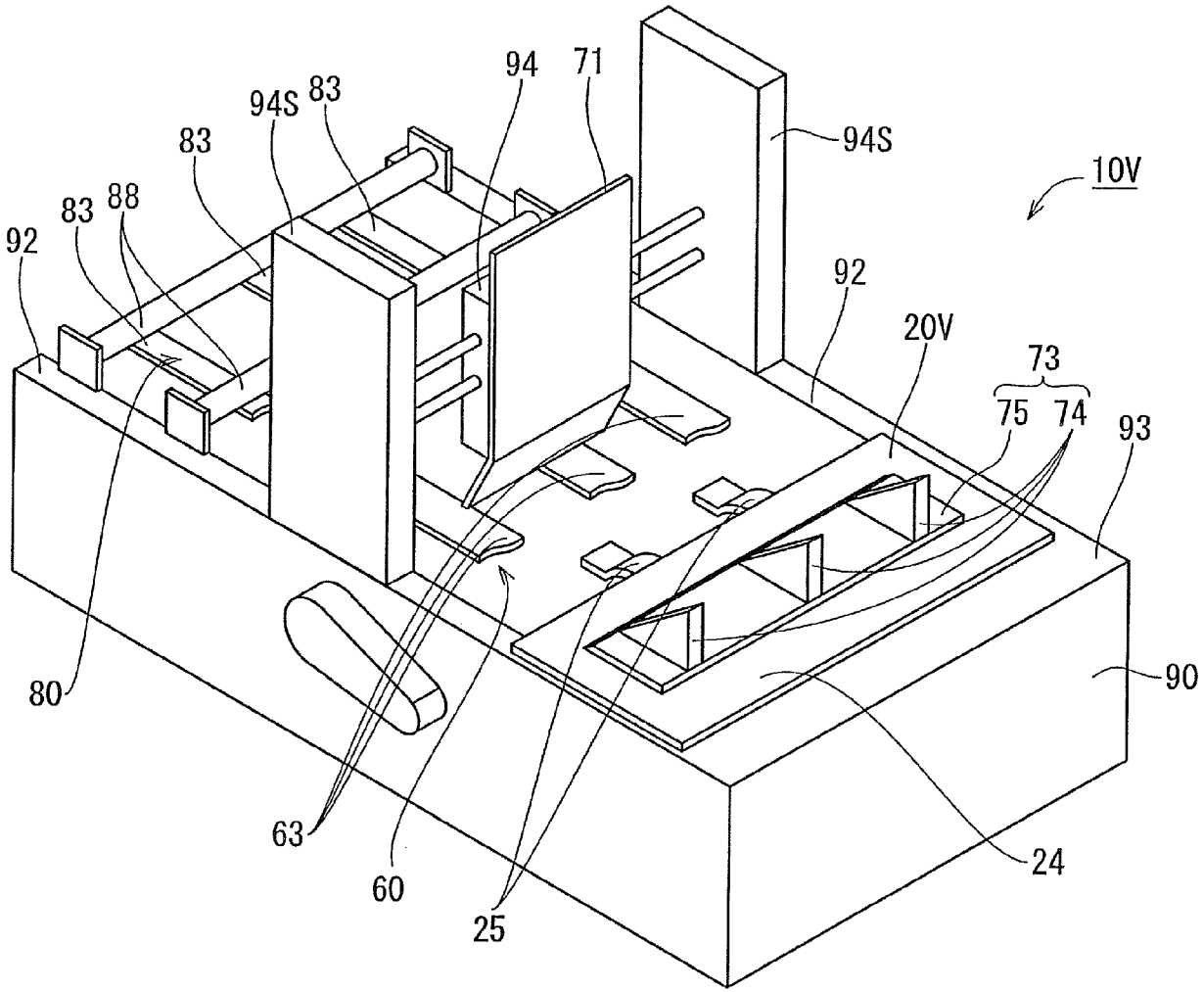
FIG. 7 is a perspective rear view illustrating a cut-sheet feeder according to a second embodiment.

Hereinafter, a description will be made of a second embodiment of the present invention with reference to FIGS. 7 to 9. As shown in FIG. 7, a cut-sheet feeder 10V according to this embodiment features that the configuration of a belt contact amount adjuster 20V is mainly different from the configuration of the belt contact amount adjuster 20 of the first embodiment.

The belt contact amount adjuster 20V has a cover section 24 with an upper surface parallel to a horizontal plane, and the cover section 24 covers the range of the rotational contact surface 63M of the feed belts 63 from the rear end to an intermediate position thereof. Note that, more specifically, the cover section 24 is horizontal plate-shaped and aligned so as to be sandwiched between an upper surface plate 93 and the mounting plate 75 of the inclined guide member 73.

Figure 8:
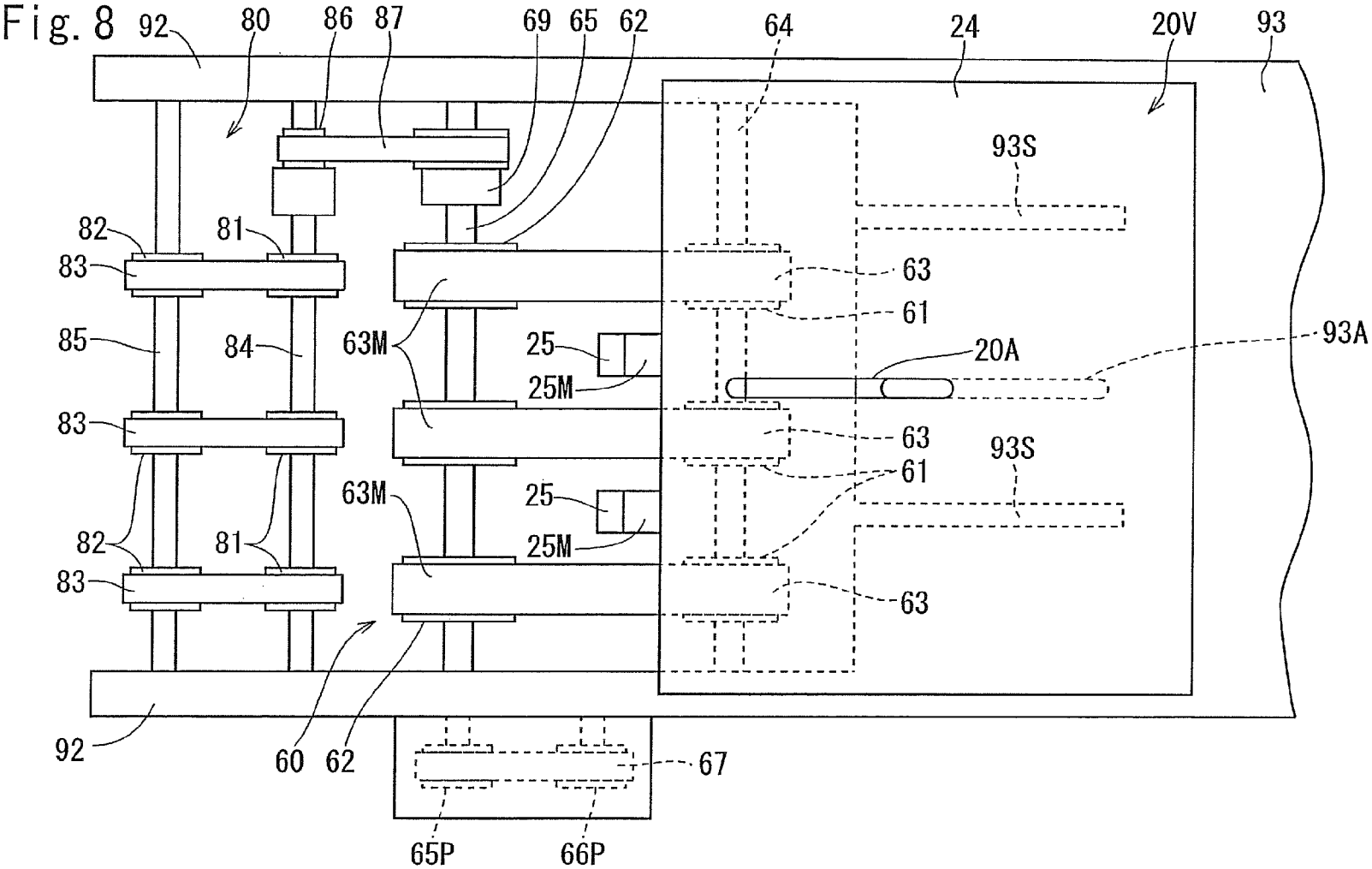
FIG. 8 is a plan view illustrating a belt contact amount adjuster according to the second embodiment.

As shown in FIG. 8, the cover section 24 has the first elongated guide hole 20A which is formed to penetrate therethrough in the same manner as with the belt contact amount adjuster 20 of the first embodiment. Then, with the first elongated guide hole 20A and the elongated base hole 93A of the upper surface plate 93 overlapping each other, the nut N is fastened to the bolt B having penetrated through the elongated holes 20A and 93A, thereby fixing the belt contact amount adjuster 20 to the upper surface plate 93. That is, the cut-sheet feeder 10V of this embodiment is configured to include the belt contact amount adjusting mechanism 26 of the first embodiment. Note that a slight gap is formed between the cover section 24 and the feed belts 63, so that the cover section 24 is not brought into contact with the feed belts 63.

Figure 9:
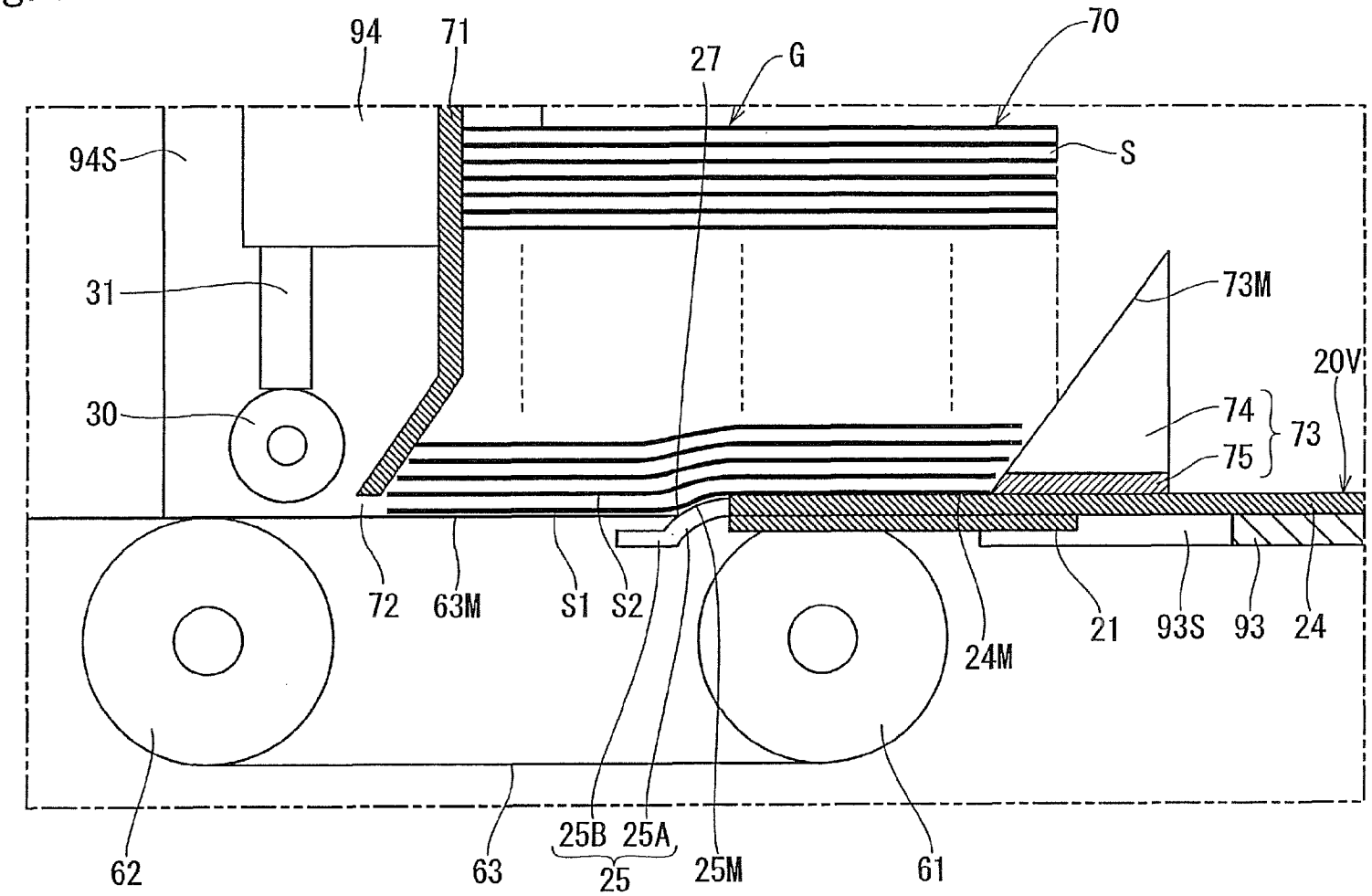
FIG. 9 is a sectional side view illustrating a stack of cut sheets and the surrounding thereof according to the second embodiment.

Furthermore, as shown in FIG. 9, on the lower surface of the cover section 24, the engaging projections 21 and 21 which are the same as those of the first embodiment are provided (only one of the engaging projections is illustrated in FIG. 9). The engaging projections 21 and 21 are engaged with the slits 93S and 93S of the upper surface plate 93 (see FIG. 8) so as to restrict movement of the belt contact amount adjuster 20V in the width direction (in the vertical direction of FIG. 8).

As shown in FIG. 7, the belt contact amount adjuster 20V includes a plurality of hand-over projections 25 which are protruded from the front end of the cover section 24. As shown in FIG. 8, the hand-over projections 25 and the feed belts 63 are disposed alternately side by side, and the front end portion of the hand-over projections 25 is disposed below the rotational contact surface 63M of the feed belts 63. Then, as shown in FIG. 9, the plurality of hand-over projections 25 and the plurality of feed belts 63 form a hand-over section 27 of the present invention.

More specifically, as shown in FIG. 9, the hand-over projection 25 is constituted by an inclined section 25A which is inclined from the front end of the cover section 24 forwardly downward and a straight section 25B which forwardly extends from the front end of the inclined section 25A. The upper surface of the rear end portion of the inclined section 25A is located above the rotational contact surface 63M of the feed belt 63, while the upper surface of the front end portion of the inclined section 25A is located below the rotational contact surface 63M. Then, a section of the upper surface of the hand-over projections 25 constitutes a hand-over inclined surface 25M of the present invention, the section being disposed above the rotational contact surface 63M of the feed belt 63, and the upper surface of the cover section 24 constitutes a cut-sheet main support surface 24M of the present invention. Note that, more specifically, the upper surface of the inclined section 25A is curved so as to be oriented downwardly in the forward direction.

In the foregoing, the belt contact amount adjuster 20V has been completely described. Other components of the cut-sheet feeder 10V are configured in the same manner as those of the cut-sheet feeder 10 of the aforementioned first embodiment, and will be denoted with identical symbols without repeated explanations.

The cut-sheet feeder 10V according to this embodiment can provide the same effects as those of the cut-sheet feeder 10 of the first embodiment. Furthermore, the front end portion of a section of the hand-over projection 25, the section being located above the rotational contact surface 63M of the feed belt 63, that is, the hand-over inclined surface 25M is inclined forwardly downward. Thus, when the cut sheet S is drawn from the stack of cut sheets G, it is possible to smoothly hand over the rear portion of the cut sheet S supported by the belt contact amount adjuster 20V to the feed belts 63. In addition, according to this embodiment, since the upper surface of the hand-over projection 25 and the rotational contact surface 63M intersect when viewed from the side, the cut sheet S can be prevented from being folded at the hand-over section.

Third Embodiment

Figure 10:
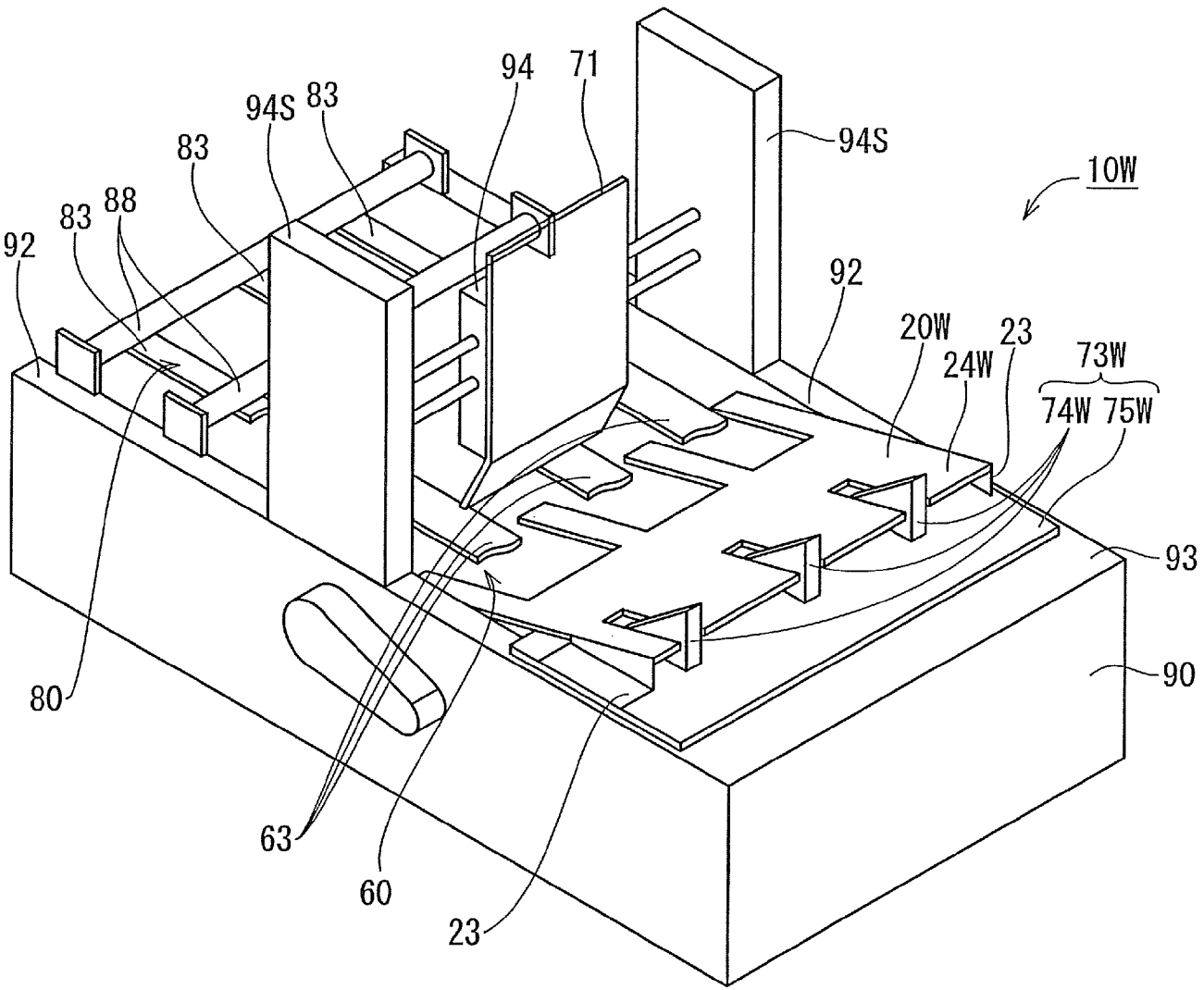
FIG. 10 is a perspective rear view illustrating a cut-sheet feeder according to a third embodiment.

Hereinafter, a description will be made of a third embodiment of the present invention with reference to FIGS. 10 to 13. As shown in FIG. 10, a cut-sheet feeder 10W of this embodiment features that the configuration of a belt contact amount adjuster 20W is mainly different from that of the belt contact amount adjuster 20V of the second embodiment. More specifically, the belt contact amount adjuster 20W has a flat surface, the upper surface of the entirety of which is inclined forwardly downward.

Figure 11:
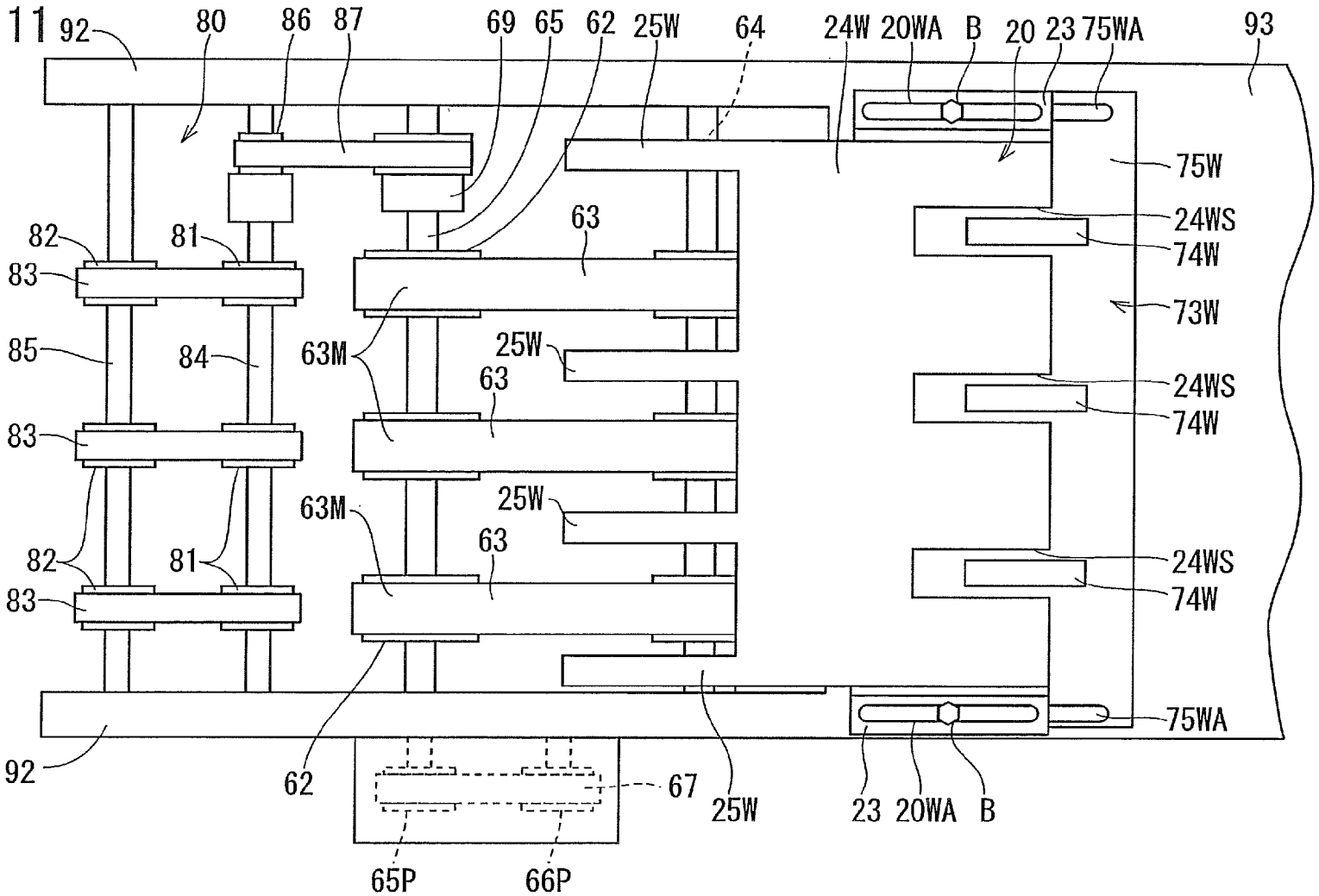
FIG. 11 is a plan view illustrating a belt contact amount adjuster according to the third embodiment.

As shown in FIGS. 10 and 11, the belt contact amount adjuster 20W includes a plurality of hand-over projections 25W disposed between adjacent feed belts 63 and 63 and a cover section 24W in communication with the rear ends of the plurality of hand-over projections 25W. The cover section 24W is provided at the rear end portion with a plurality of slits 24WS so as to allow the triangular plates 74W of inclined guide members 73W to be movable in the back-and-forth direction in the slits 24WS. Note that the upper surface of the cover section 24W serves as a main support surface 24WM for supporting a stack of cut sheets according to the present invention and is located below a guide surface 73WM of the inclined guide member 73W when viewed from the side (see FIG. 12).

Figure 13:
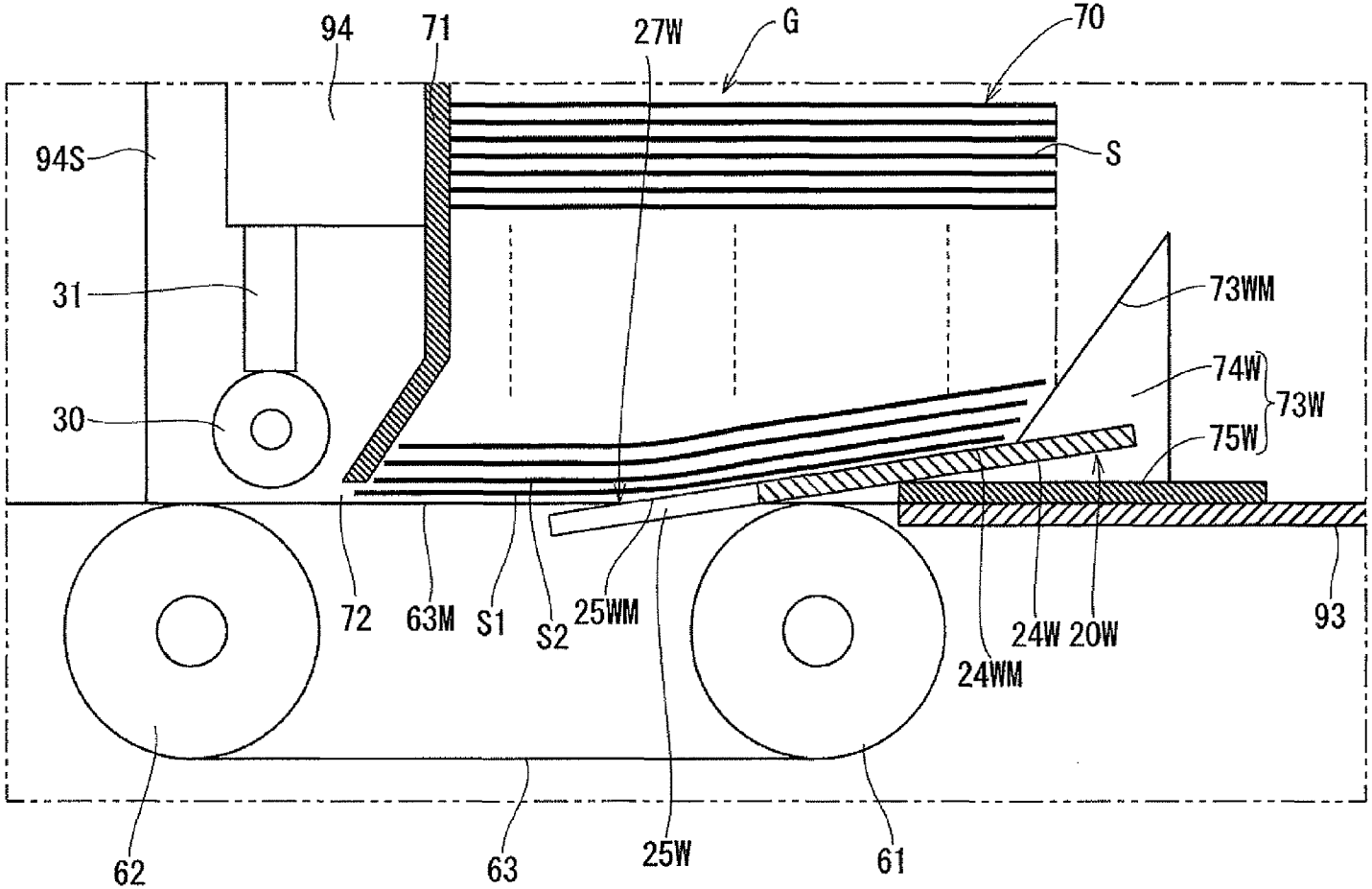
FIG. 13 is a sectional side view illustrating a stack of cut sheets and the surrounding thereof according to the third embodiment.

As shown in FIG. 13, the hand-over projections 25W have the upper surface of the rear end portion which is located above the rotational contact surface 63M and the upper surface of the front end portion which is located below the rotational contact surface 63M. Note that a section of the upper surface of the hand-over projection 25W, the section being located above the feed belt 63, serves as a hand-over inclined surface 25WM according to the present invention. Furthermore, the plurality of hand-over projections 25W and the plurality of feed belts 63 constitute a hand-over section 27W of the present invention.

Furthermore, as shown in FIG. 10, on the both side portions of the cover section 24W, there are provided brackets 23 and 23 for fixing the belt contact amount adjuster 20W to the upper surface plate 93. The bracket 23 has the shape of a letter "L" when viewed in the back-and-forth direction, and a bottom plate 23T thereof, which is stacked on the mounting plate 75W of the inclined guide member 73W.

Figure 12:
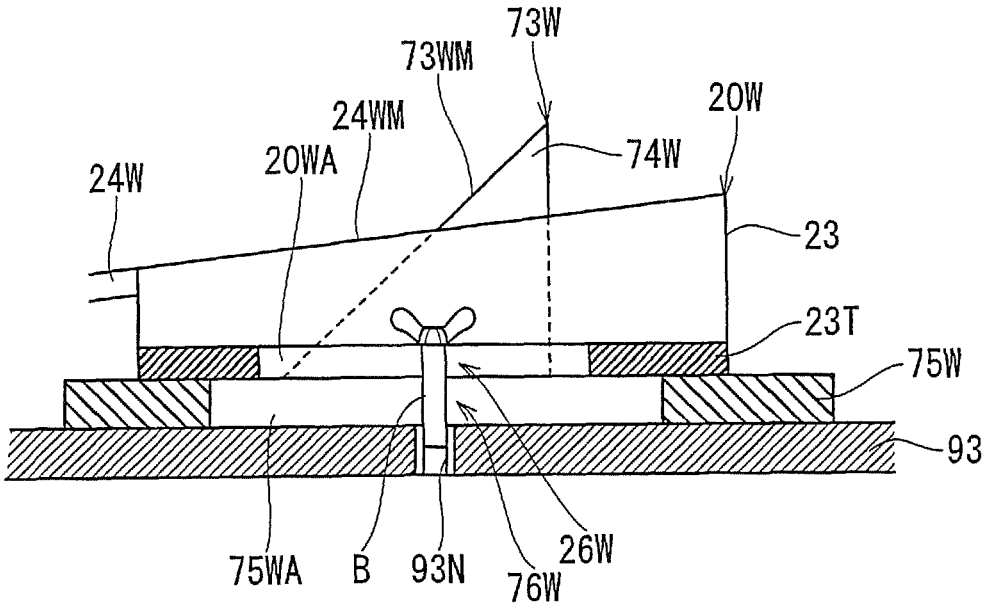
FIG. 12 is a sectional side view illustrating the belt contact amount adjuster and an inclined guide member according to the third embodiment.

As shown in FIG. 12, the bottom plate 23T of the bracket 23 has a first elongated guide hole 20WA which is formed to extend in the back-and-forth direction. Furthermore, the mounting plate 75W of the inclined guide member 73W also has a second elongated guide hole 75WA which is formed to extend in the back-and-forth direction and penetrate therethrough. Then, with the first elongated guide hole 20WA and the second elongated guide hole 75WA overlapping each other, the bolt B penetrating through the first elongated guide hole 20WA and the second elongated guide hole 75WA is screwed into a spiral hole 93N formed in the upper surface plate 93, thereby allowing the belt contact amount adjuster 20W and inclined guide member 73W to be fixed to the upper surface plate 93.

Then, by loosening the bolt B and then moving the inclined guide member 73W along the second elongated guide hole 75WA, it is possible to selectively adjust the position of the inclined guide member 73W in the back-and-forth direction depending on the size of the cut sheet S. That is, in this embodiment, the second elongated guide hole 75WA serves as the "second guide" of the present invention, and the bolt B and the spiral hole 93N constitute the "second fixing part" of the present invention. Then, the second elongated guide hole 75WA, the bolt B, and the spiral hole 93N constitute an inclined guide member variable support mechanism 76W of the present invention.

Furthermore, by loosening the bolt B and then moving the belt contact amount adjuster 20W along the first elongated guide hole 20WA, it is possible to adjust the back-and-forth position of the belt contact amount adjuster 20W separately from the inclined guide member 73W. That is, in this embodiment, the first elongated guide hole 20WA serves as the "first guide" of the present invention, and the bolt B and the spiral hole 93N constitute the "second fixing part" of the present invention. Then, the first elongated guide hole 20WA, the bolt B, and the spiral hole 93N constitute the belt contact amount adjusting mechanism 26W of the present invention.

In the foregoing, the belt contact amount adjuster 20W has been completely described. Furthermore, other components of the cut-sheet feeder 10W are configured in the same manner as those of the cut-sheet feeder 10V of the aforementioned second embodiment, and will be denoted with identical symbols without repeated explanations. The cut-sheet feeder 10W according to this embodiment can provide the same effects as those of the second embodiment.

Fourth Embodiment

Figure 14:
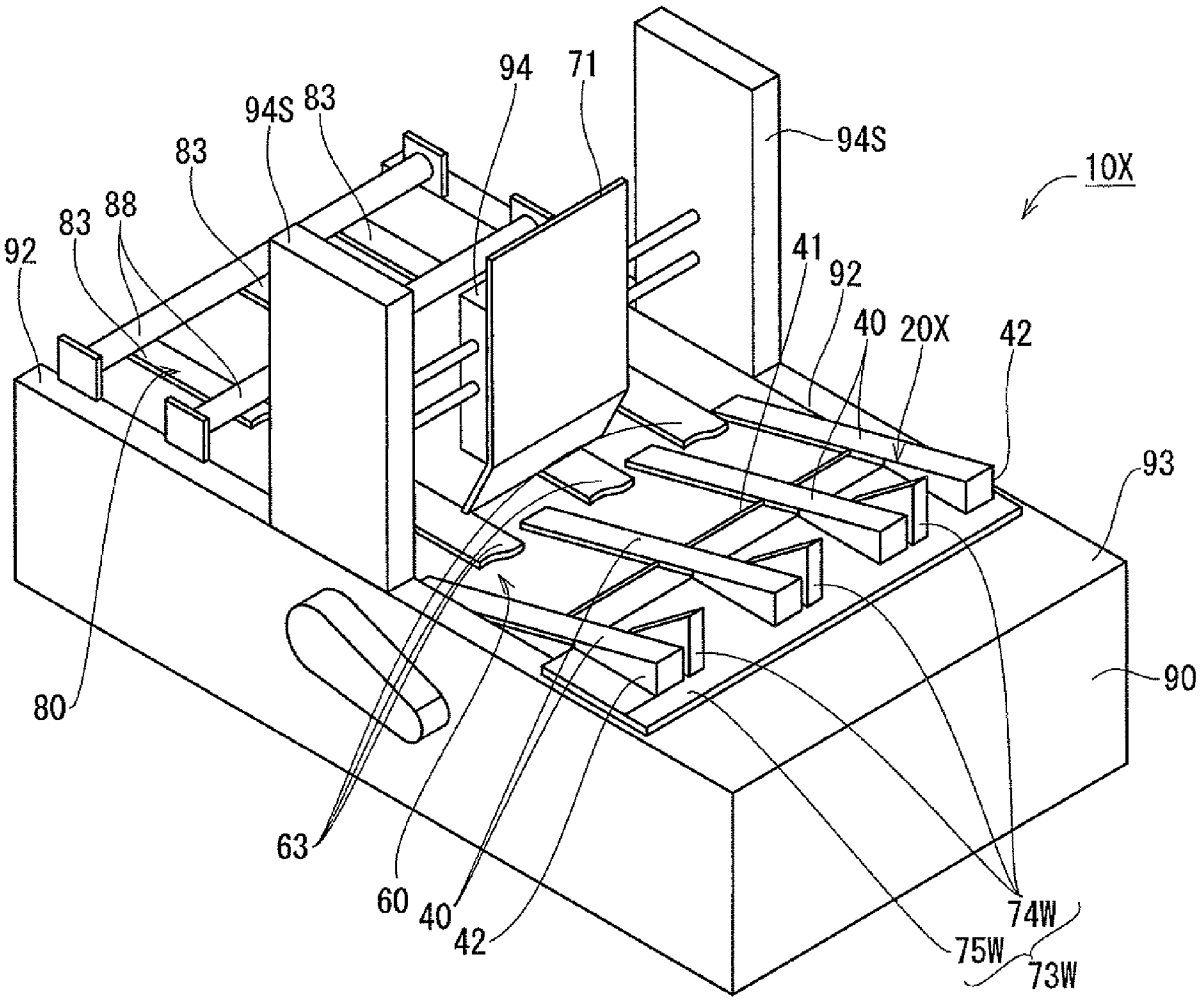
FIG. 14 is a perspective rear view illustrating a cut-sheet feeder according to a fourth embodiment.
Figure 15:
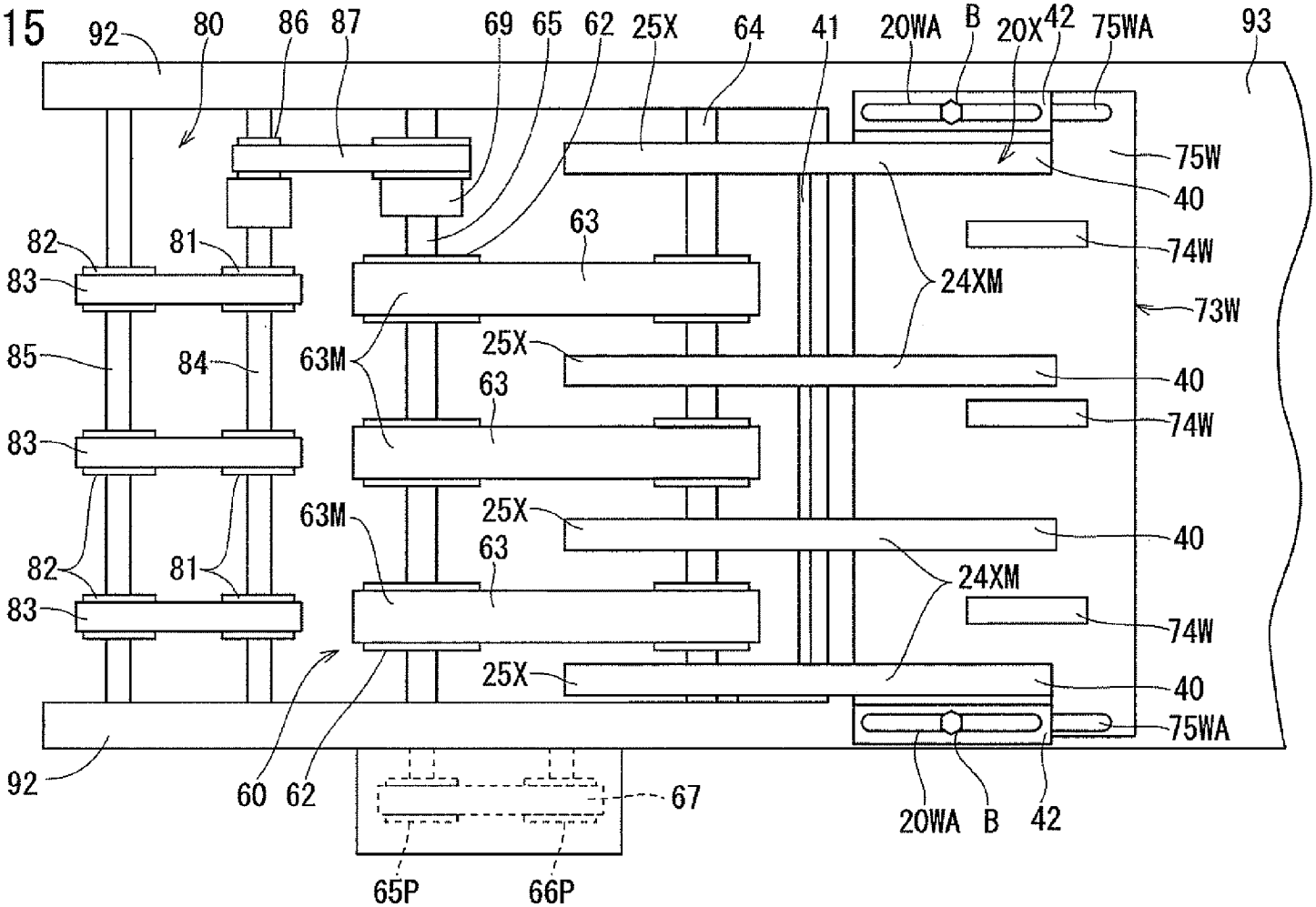
FIG. 15 is a plan view illustrating a belt contact amount adjuster according to the fourth embodiment.

Hereinafter, a description will be made of a fourth embodiment of the present invention with reference to FIGS. 14 to 16. As shown in FIG. 14, a cut-sheet feeder 10X of this embodiment features that the configuration of a belt contact amount adjuster 20X is mainly different from that of the belt contact amount adjuster 20W of the third embodiment.

The belt contact amount adjuster 20X includes a plurality of strip-shaped members 40 which are elongated in the back-and-forth direction and disposed side by side. The strip-shaped members 40 are coupled to each other by a coupling shaft 41 at an intermediate position in the back-and-forth direction. As shown in FIG. 15, the feed belts 63 and the strip-shaped members 40 are disposed alternately. Furthermore, the cut-sheet feeder 10X has the inclined guide members 73W of the aforementioned third embodiment, so that the rear portions of the strip-shaped members 40 are disposed between the adjacent triangular plates 74W of the inclined guide member 73W. Note that the inclined guide member 73W canoe fixed at a given position in the back-and-forth direction by means of the inclined guide member variable support mechanism 76W as described in the third embodiment.

Figure 16:
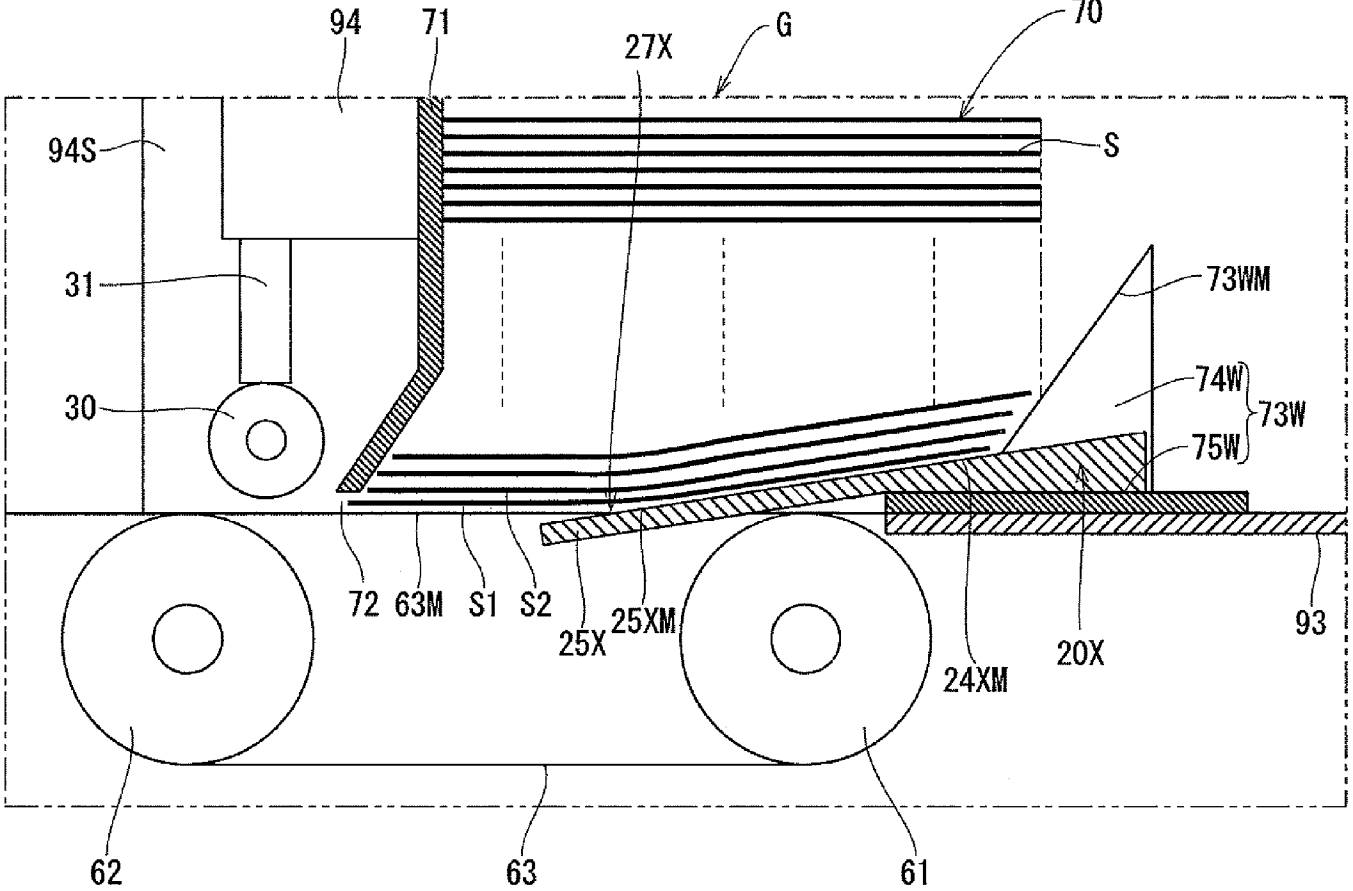
FIG. 16 is a sectional side view illustrating a stack of cut sheets and the surrounding thereof according to the fourth embodiment.

As shown in FIG. 16, the strip-shaped member 40 has a flat surface, the entire upper surface of which is inclined forwardly downward. The rear end of the upper surface of the strip-shaped member 40 is disposed above the rotational contact surface 63M of the feed belt 63, whereas the front end thereof is disposed below the rotational contact surface. Furthermore, the strip-shaped member 40 is configured such that the rear portion is formed of a trapezoidal block and the front portion is formed as a plate-shaped hand-over projection 25X which is inclined forwardly downward. Then, a section of the upper surface of the hand-over projection 25X, the section being located above the rotational contact surface 63M, constitutes a hand-over inclined surface 25XM of the present invention, and a section of the upper surface of the strip-shaped member 40, the section being more rearward than the hand-over inclined surface 25XM, constitutes a cut-sheet main support surface 24XM. Furthermore, a plurality of hand-over projections 25X and a plurality of feed belts 63 form the hand-over section 27X of the present invention.

Furthermore, as shown in FIG. 14, the outer strip-shaped members 40 and 40 in the width direction of the feed belts 63 include brackets 42 and 42 for fixing the strip-shaped members 40 to the upper surface plate 93. The bracket 42 is configured in the same manner as the bracket 23 of the aforementioned third embodiment, so that the belt contact amount adjuster 20X includes the belt contact amount adjusting mechanism 26W described in the third embodiment.

In the foregoing, the belt contact amount adjuster 20X has been completely described. Other components of the cut-sheet feeder 10X are configured in the same manner as those of the cut-sheet feeder 10W of the third embodiment, and will be denoted with identical symbols without repeated explanations. The cut-sheet feeder 10X according to this embodiment can provide the same effects as those of the aforementioned second and the third embodiments.

Fifth Embodiment

Figure 17:
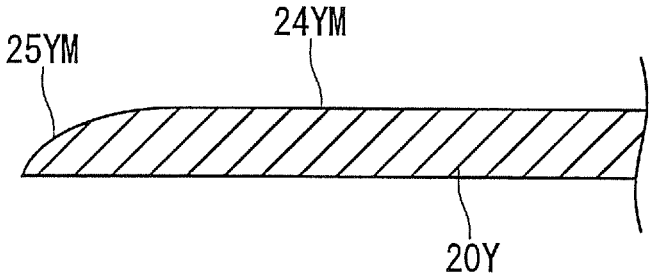
FIG. 17 is a sectional side view illustrating a belt contact amount adjuster according to a fifth embodiment.

This embodiment is a modification of the belt contact amount adjuster 20 according to the aforementioned first embodiment. As shown in FIG. 17, a belt contact amount adjuster 20Y of this embodiment is a horizontal plate with a deformed front end portion, and the upper surface of the front end portion has a hand-over inclined surface 25YM which is inclined forwardly downward. Furthermore, a section of the upper surface of the belt contact amount adjuster 20Y, the section being more rearward than the hand-over inclined surface 25YM, serves as a cut-sheet main support surface 24YM. Note that, more specifically, the hand-over inclined surface 25YM is curved in an elliptical shape so as to be oriented downwardly in the forward direction when viewed from the side.

This embodiment can provide the same effects as those of the aforementioned first embodiment. Furthermore, the hand-over inclined surface 25YM is inclined forwardly downward. Thus, when the cut sheet S is drawn from the stack of cut sheets G, it becomes possible to smoothly hand over the rear portion of the cut sheet S supported by the belt contact amount adjuster 20Y to the feed belts 63.

Other Embodiments

The present invention is not limited to the embodiments above; for example, the embodiments to be mentioned below will also be included in the range of the technical features of the present invention, and the invention may be further practiced other than mentioned as below by making various modifications in the invention without departing from the scope and spirit thereof.

(1) In the aforementioned second and fifth embodiments, the cut-sheet main support surface 24M is horizontal; however, the surface 24M may also be inclined forwardly downward relative to a horizontal plane at a smaller angle than that of the hand-over inclined surface 25M with respect to the plane.

(2) In the aforementioned second to fourth embodiments, a plurality of feed belts and hand-over projections are included and disposed alternately; however, it is also acceptable that a pair of feed belts is included and a hand-over projection is disposed between the pair of feed belts, or alternatively a pair of hand-over projections is included and a feed belt is disposed between the pair of hand-over projections.

(3) In place of the strip-shaped member 40 of the aforementioned fourth embodiment, a plate-shaped member which is inclined forwardly downward may also be employed.

Figure 18A:
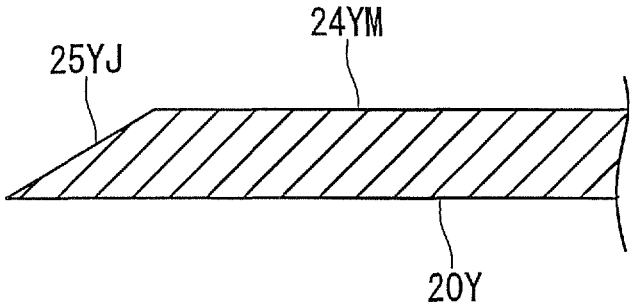
FIG. 18A is a sectional side view illustrating a belt contact amount adjuster according to a modified example.
Figure 18B:
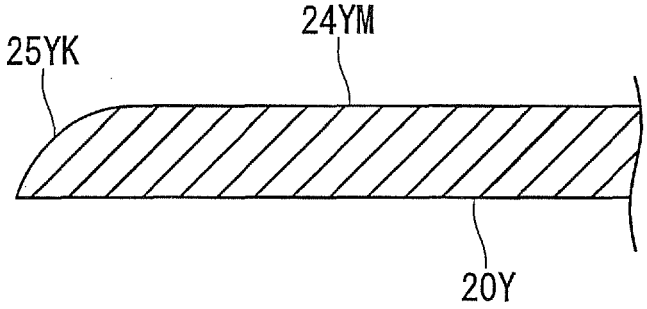
FIG. 18B is a sectional side view illustrating a belt contact amount adjuster according to a modified example.
Figure 18C:
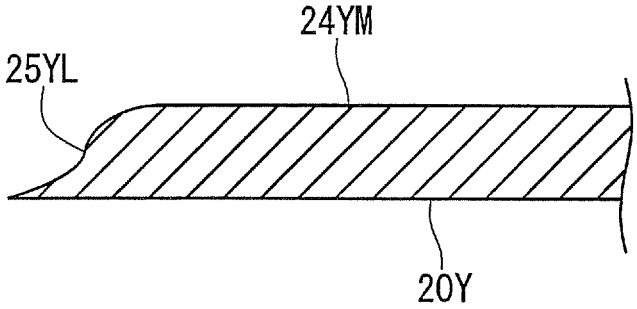
FIG. 18C is a sectional side view illustrating a belt contact amount adjuster according to a modified example.

(4) The shape of the hand-over inclined surface 25YM of the aforementioned fifth embodiment is not limited to that shown in FIG. 17; for example, it may also be like a hand-over inclined surface 25YJ, 25YK, or 25YL shown in FIG. 18A to FIG. 18C.

(5) In the aforementioned embodiment, the feed belt 63 and the downstream feed belt 83 are driven by the same driving source; however, each may also be driven by a separate driving source.

(6) In the aforementioned embodiment, the upper surface plate 93 and the rotational contact surface 63M of the feed belt 63 are horizontally disposed; however, they may also be inclined so as to be forwardly lowered relative to a horizontal plane. Furthermore, at that time, the cut-sheet main support surface may be disposed in parallel to the rotational contact surface 63M.

(7) In the aforementioned first to fifth embodiments, the belt contact amount adjusting mechanism 26 and the inclined guide member variable support mechanism 76 which are described in the aforementioned first embodiment may each be exchanged with the belt contact amount adjusting mechanism 26W and the inclined guide member variable support mechanism 76W which are described in the aforementioned second embodiment.

Figure 19:
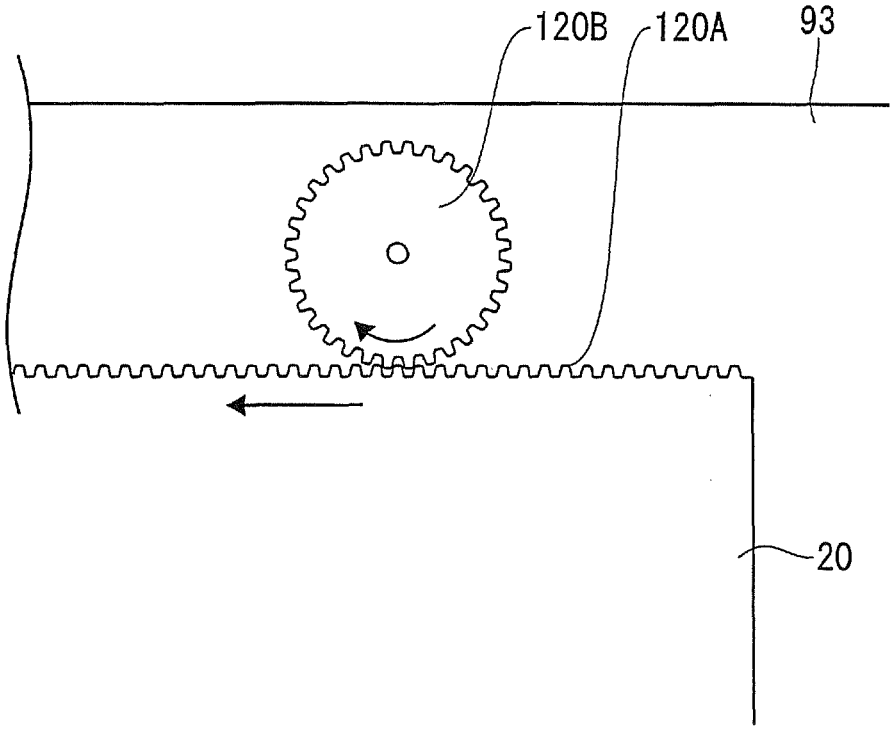
FIG. 19 is a plan view illustrating a belt contact amount adjusting mechanism according to a modified example.
Figure 20:
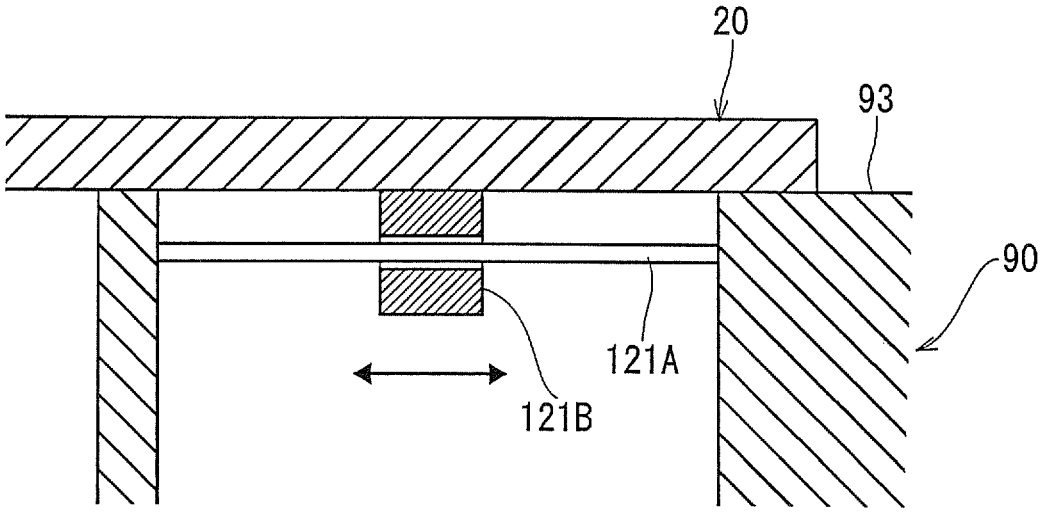
FIG. 20 is a sectional side view illustrating a belt contact amount adjusting mechanism according to a modified example.

(8) The rack and pinion mechanism may be employed to constitute the "belt contact amount adjusting mechanism" of the present invention. More specifically, as shown in FIG. 19, the belt contact amount adjuster 20 may be provided with a rack 120A which extends in the back-and-forth direction (equivalent to the "first guide" of the present invention), while a pinion 120B mating with the rack 120A (equivalent to the "first fixing part" of the present invention) may be provided on the upper surface plate 93. On the other hand, a ball screw mechanism may be employed to constitute the "belt contact amount adjusting mechanism" of the present invention. More specifically, as shown in FIG. 20, the belt contact amount adjuster 20 may be provided with a ball screw 121A which extends in the back-and-forth direction (equivalent to the "first guide" of the present invention), and with a ball nut 121B which is screwed over the ball screw 121A (equivalent to the "first fixing part" of the present invention). Note that the rack and pinion mechanism and the ball screw mechanism may be applied to the inclined guide member variable support mechanism.

(9) It is also acceptable to employ a magnet as the "belt contact amount adjusting mechanism" and the "inclined guide member variable support mechanism" of the present invention. More specifically, in the aforementioned example of the first embodiment, the lower surface of the belt contact amount adjuster 20 and the upper surface plate 93 as well as the upper surface of the belt contact amount adjuster 20 and the inclined guide member 73 may be adapted to be coupled to each other by a magnet so that the belt contact amount adjuster 20 and the inclined guide member 73 can be fixed at a given position in the back-and-forth direction.

Figure 21A:
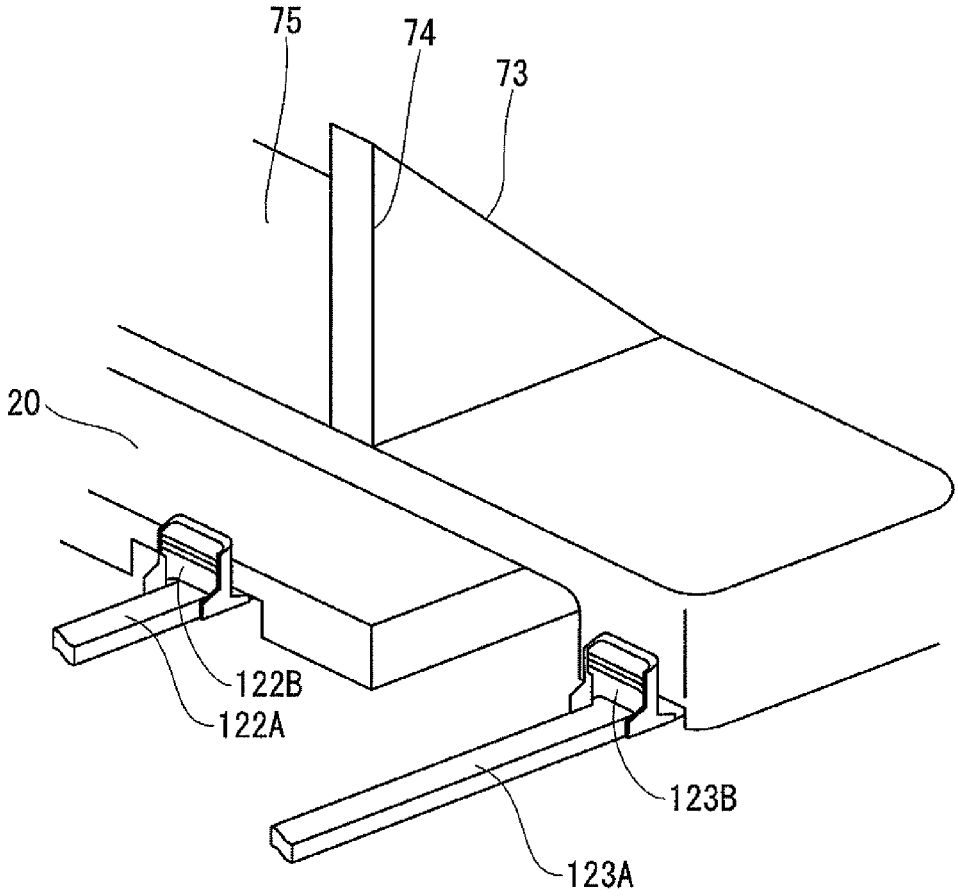
FIG. 21A is a perspective rear view illustrating a belt contact amount adjuster and an inclined guide member according to a modified example.
Figure 21B:
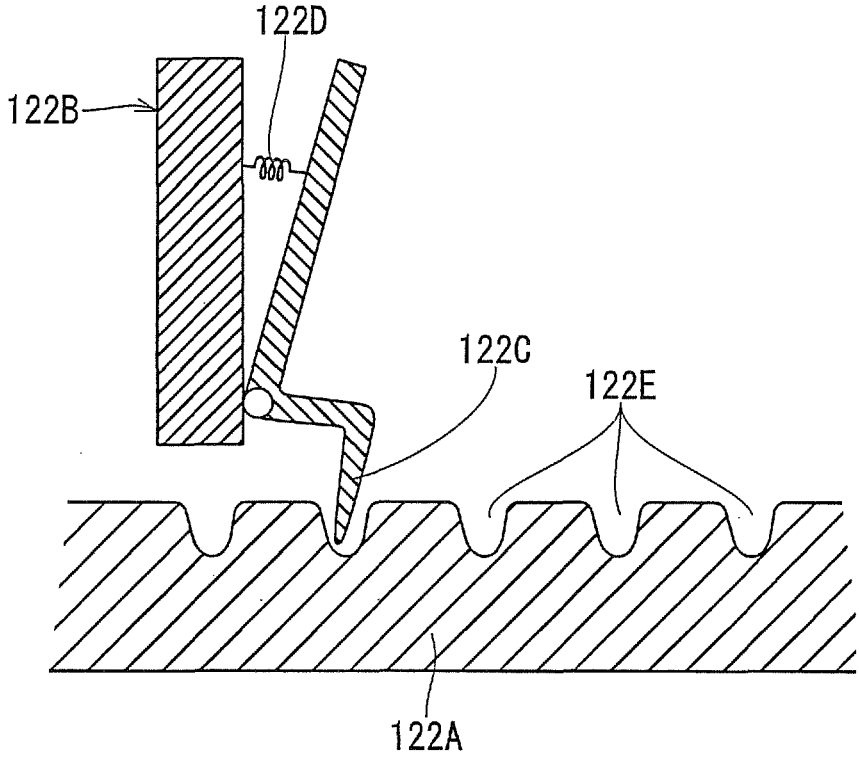
FIG. 21B is a sectional side view illustrating a belt contact amount adjusting mechanism according to a modified example.

(10) As shown in FIG. 21A, on the upper surface of the upper surface plate 93, it is also acceptable to provide a first guide rail 122A which extends in the back-and-forth direction (equivalent to the "first guide" of the present invention) and a first slider 122B which moves integrally with the belt contact amount adjuster 20 and can be fixed at a given position along the first guide rail 122A. More specifically, as shown in FIG. 21B, the first slider 122B includes a first locking pawl 122C which can reciprocate between a first locking position at which the first locking pawl 122C is locked in a first locking section 122E formed in the first guide rail 122A and a first release position at which the locking is released. The first slider also includes a first spring 122D for energizing the first locking pawl 122C to the first locking position. Furthermore, in order to constitute the "inclined guide member variable support mechanism" of the present invention, it is also acceptable to employ a second guide rail 123B (equivalent to the "second guide" of the present invention) which is formed on the upper surface of the upper surface plate 93 and extends in the back-and-forth direction, and a second slider 123A (equivalent to the "second fixing part" of the present invention) which moves integrally with the inclined guide member 73 and can be fixed at a given position along the second guide rail 123A. Note that the second guide rail 123A and the second slider 123B are configured in the same manner as the first guide rail 122A and the first slider 122B.

Figure 22:
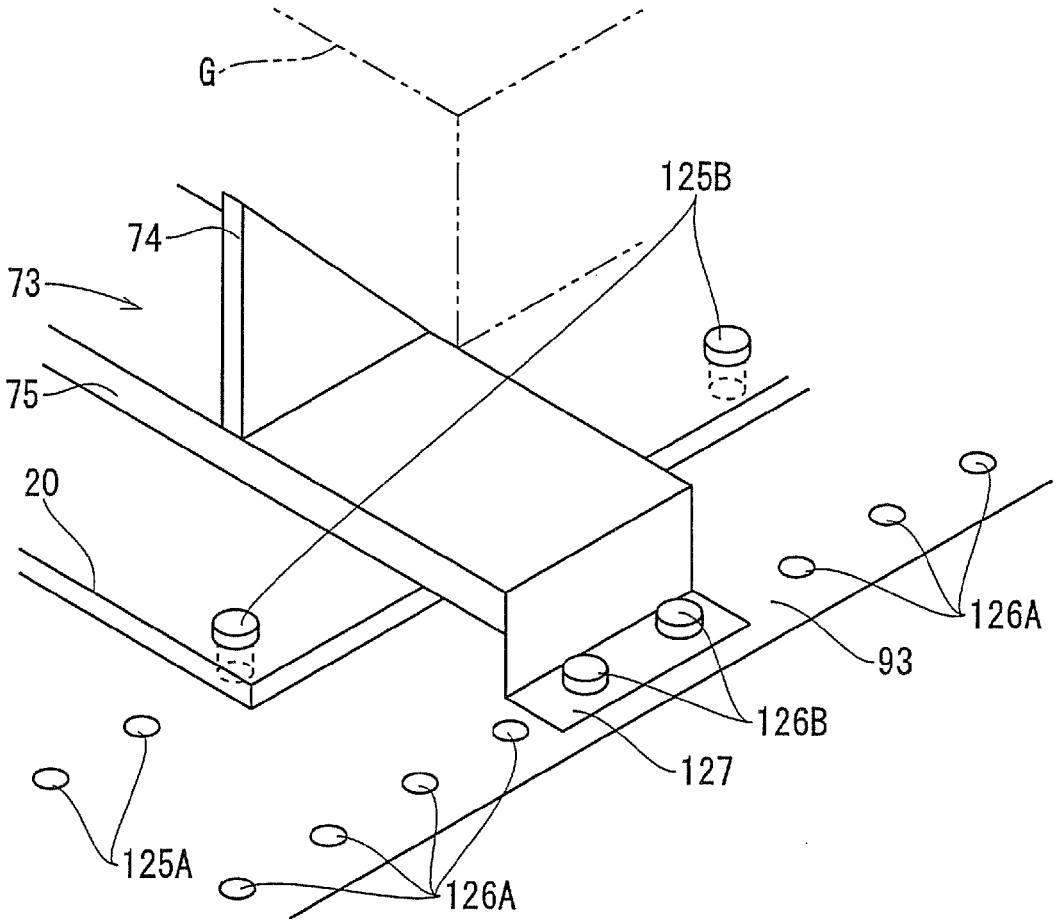
FIG. 22 is a perspective rear view illustrating a belt contact amount adjuster and an inclined guide member according to a modified example.

(11) As shown in FIG. 22, the "belt contact amount adjusting mechanism" of the present invent ion may be constituted by first positioning holes 125A formed on the upper surface of the upper surface plate 93 and aligned in the back-and-forth direction and first positioning pins 125B penetrating through the belt contact amount adjuster 20 and engaging with the first positioning holes 125A. Furthermore, likewise, the "inclined guide member variable support mechanism" of the present invention may be constituted by second positioning holes 126A formed on the upper surface of the upper surface plate 93 and aligned in the back-and-forth direction, and second positioning pins 126E which penetrate through a bracket 127 moving integrally with the inclined guide member 73 and engage with the second positioning hole 126A.

Figure 23:
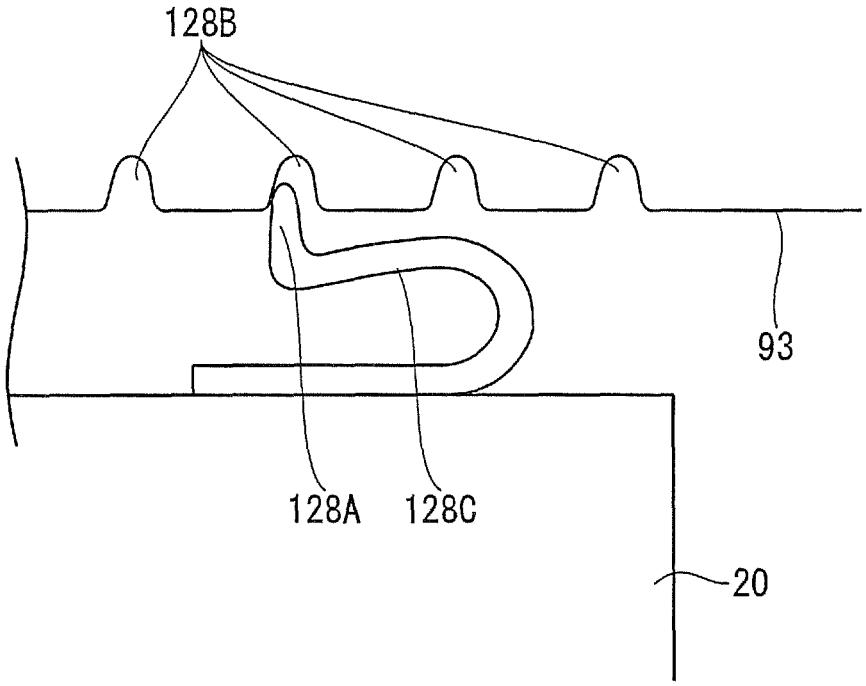
FIG. 23 is a plan view illustrating a belt contact amount adjusting mechanism according to a modified example.

(12) As shown in FIG. 23, the belt contact amount adjuster 20 may be provided with an elastic member 128C (equivalent to the "first spring" of the present invention) with the tip end being outwardly energized. Furthermore, the elastic member 128C may be provided at the tip end with a first locking pawl 128A formed to be protruded outwardly, and a plurality of first locking sections 128B which can engage with the first locking pawl 128A are provided in the upper surface plate 93 so as to be aligned in the back-and-forth direction, thereby constituting the belt contact amount adjusting mechanism. Note that the configuration of the belt contact amount adjusting mechanism may be applied to the guide variable support mechanism.

Figure 24:
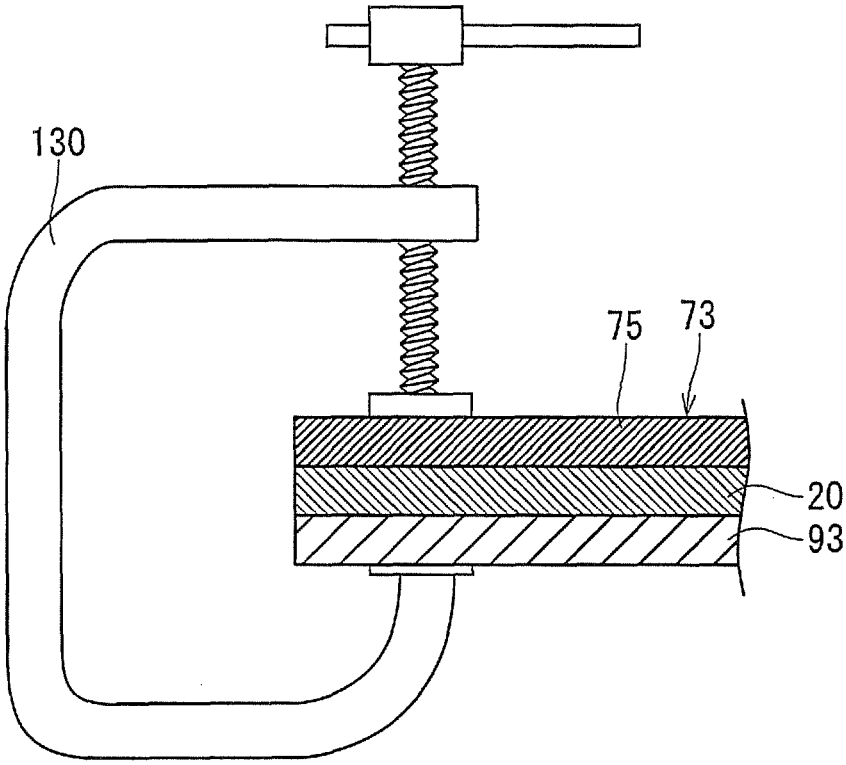
FIG. 24 is a sectional side view illustrating a belt contact amount adjuster and an inclined guide member according to a modified example.

(13) It is also acceptable to use a clamp as the "belt contact amount adjusting mechanism" and the "inclined guide member variable support mechanism" of the present invention. That is, as shown in FIG. 24, the belt contact amount adjuster 20, the mounting plate 75 of the inclined guide member 73, and the upper surface plate 93 may be clamped with a clamp 130, thereby allowing the clamp 130 to fix the belt contact amount adjuster 20 and the inclined guide member 73 at a given position in the back-and-forth direction.

EXPLANATION OF SYMBOLS

10, 10V, 10W, 10X: cut-sheet feeder
20, 20V, 20W, 20X, 20Y: belt contact amount adjuster
20A, 20WA: first elongated guide hole (first guide)
24, 24W: cover section
24M, 24WM, 24XM, 24YM: cut-sheet main support surface
25, 25W, 25X: hand-over projection
25M, 25WM, 25XM, 25YM, 25YJ, 25YK, 25YL: hand-over inclined surface
26, 26W: belt contact amount adjusting mechanism
27, 27W, 27X: hand-over section
63: feed belt
63M: rotational contact surface
73, 73W: inclined guide member
73M, 73WM: guide surface
75A, 75WA: second elongated guide hole (second guide)
76, 76W: inclined guide member variable support mechanism
B: bolt (first fixing part, second fixing part)
G: stack of cut sheets
N: nut (first fixing part, second fixing part)
S: cut sheet

The invention claimed is:

1. A cut-sheet feeder for bringing a feed belt into rotational contact with the lowermost cut sheet of a stack of cut sheets, one stacked on another, and for drawing and feeding the lowermost cut sheet sequentially from the stack of cut sheets in the forward direction of feeding of cut sheets, the cut-sheet feeder comprising:

a belt contact amount adjuster disposed below the stack of cut sheets, and while a rear portion of the lowermost cut sheet of the stack of cut sheets from an intermediate position in the direction of feeding of cut sheets being lifted off the feed belt, supporting a front portion from the intermediate position rotationally contactably with the feed belt, an inclined guide member disposed below the rear end of the stack of cut sheets and protruded above the belt contact amount adjuster, the inclined guide member also having a guide surface inclined downwardly in the forward direction and shifting the plurality of cut sheets included in the stack of cut sheets along the guide surface in the direction of feeding of cut sheets, an inclined guide member variable support mechanism being capable of moving and fixing the inclined guide member at a given position in the direction of feeding of cut sheets, and a belt contact amount adjusting mechanism being capable of moving separately from the inclined guide member and of fixing the belt contact amount adjuster at a given position in the direction of feeding of cut sheets.

2. The cut-sheet feeder according to claim 1, comprising:

a hand-over inclined surface inclined forwardly downward and formed at the front end portion of a section of the upper surface of the belt contact amount adjuster, the section being located above the rotational contact surface of the feed belt with the cut sheet.

3. The cut-sheet feeder according to claim 2, comprising:

a cut-sheet main support surface formed on a section of the upper surface of the belt contact amount adjuster and formed at a smaller angle of inclination with respect to a horizontal plane than the hand-over inclined surface, the section being more rearward than the hand-over inclined surface.

4. The cut-sheet feeder according to claim 1, wherein the belt contact amount adjuster is configured such that the entirety of a section to be brought into contact with the stack of cut sheets is a flat surface which is inclined forwardly downward.

5. The cut-sheet feeder according to claim 1, comprising:

a hand-over projection provided on the belt contact amount adjuster and disposed to a side of the feed belt, the hand-over projection being inclined such that the upper surface of a front end portion is located below the rotational contact surface of the feed belt with the cut sheet and the upper surface of a rear end portion is located above the rotational contact surface, and a hand-over section configured to have the hand-over projection disposed between a pair of the feed belts or to have the feed belt disposed between a pair of the hand-over projections.

6. The cut-sheet feeder according to claim 3, comprising:

a hand-over projection provided on the belt contact amount adjuster and disposed to a side of the feed belt, the hand-over projection being inclined such that the upper surface of a front end portion is located below the rotational contact surface of the feed belt with the cut sheet and the upper surface of a rear end portion is located above the rotational contact surface, and a hand-over section configured to have the hand-over projection disposed between a pair of the feed belts or to have the feed belt disposed between a pair of the hand-over projections.

7. The cut-sheet feeder according to claim 4, comprising:

a hand-over projection provided on the belt contact amount adjuster and disposed to a side of the feed belt, the hand-over projection being inclined such that the upper surface of a front end portion is located below the rotational contact surface of the feed belt with the cut sheet and the upper surface of a rear end portion is located above the rotational contact surface, and a hand-over section configured to have the hand-over projection disposed between a pair of the feed belts or to have the feed belt disposed between a pair of the hand-over projections.

8. The cut-sheet feeder according to claim 5, wherein the belt contact amount adjuster has a cover section to cover the feed belt from above and has the hand-over projection protruded from the front end of the cover section.

9. The cut-sheet feeder according to claim 5, wherein the belt contact amount adjusting mechanism comprises:

a first guide supporting the belt contact amount adjuster linearly movably in the direction of feeding of cut sheets; and a first fixing part capable of fixing the belt contact amount adjuster at a given position along the first guide.

10. The cut-sheet feeder according to claim 6, wherein the belt contact amount adjusting mechanism comprises:

a first guide supporting the belt contact amount adjuster linearly movably in the direction of feeding of cut sheets; and a first fixing part capable of fixing the belt contact amount adjuster at a given position along the first guide.

11. The cut-sheet feeder according to claim 7, wherein the belt contact amount adjusting mechanism comprises:

a first guide supporting the belt contact amount adjuster linearly movably in the direction of feeding of cut sheets; and a first fixing part capable of fixing the belt contact amount adjuster at a given position along the first guide.

12. The cut-sheet feeder according to claim 9, wherein the first fixing part comprises:

a plurality of first locking sections formed along the longitudinal direction of the first guide; a first locking pawl provided on the belt contact amount adjuster and being capable of reciprocating between a first locking position at which the first locking pawl is locked with a given one of the first locking sections and a first release position at which the locking with the first locking section is released; and a first spring retaining the first locking pawl at the first locking position.

13. The cut-sheet feeder according to claim 5, wherein the inclined guide member variable support mechanism comprises:

a second guide supporting the inclined guide member linearly movably in the direction of feeding of cut sheets; and a second fixing part capable of fixing the inclined guide member at a given position along the second guide.

14. The cut-sheet feeder according to claim 6, wherein the inclined guide member variable support mechanism comprises:

a second guide supporting the inclined guide member linearly movably in the direction of feeding of cut sheets; and a second fixing part capable of fixing the inclined guide member at a given position along the second guide.

15. The cut-sheet feeder according to claim 7, wherein the inclined guide member variable support mechanism comprises:

a second guide supporting the inclined guide member linearly movably in the direction of feeding of cut sheets; and a second fixing part capable of fixing the inclined guide member at a given position along the second guide.

16. The cut-sheet feeder according to claim 9, wherein the inclined guide member variable support mechanism comprises:

a second guide supporting the inclined guide member linearly movably in the direction of feeding of cut sheets; and a second fixing part capable of fixing the inclined guide member at a given position along the second guide.

17. The cut-sheet feeder according to claim 13, wherein the second fixing part comprises:

a plurality of second locking sections formed along the longitudinal direction of the second guide; a second locking pawl provided on the inclined guide member and being capable of reciprocating between a second locking position at which the second locking pawl is locked with a given one of the second locking sections and a second release position at which the locking with the second locking section is released; and a second spring retaining the second locking pawl at the second locking position.

* * * * *